US007188919B2

(12) United States Patent
Satomura

(10) Patent No.: US 7,188,919 B2
(45) Date of Patent: Mar. 13, 2007

(54) LIQUID DISCHARGE METHOD AND APPARATUS USING INDIVIDUALLY CONTROLLABLE NOZZLES

(75) Inventor: Seiichirou Satomura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/607,377

(22) Filed: Jun. 27, 2003

(65) Prior Publication Data

US 2004/0004643 A1 Jan. 8, 2004

(30) Foreign Application Priority Data

Jul. 8, 2002 (JP) ..... 2002-199214

(51) Int. Cl.
*B41J 29/38* (2006.01)
*B05D 5/06* (2006.01)
*B05C 5/00* (2006.01)

(52) U.S. Cl. ..... 347/12; 347/9; 118/300; 427/168

(58) Field of Classification Search ..... 347/9–15, 347/40–43; 118/320–326, 300; 427/162–169
See application file for complete search history.

(56) References Cited

U.S. PATENT DOCUMENTS 4,963,882 A * 10/1990 Hickman ..... 347/41
5,023,110 A 6/1991 Nomura et al. ..... 427/49
5,036,337 A * 7/1991 Rezanka ..... 347/57
5,670,205 A * 9/1997 Miyazaki et al. ..... 427/64
5,936,644 A 8/1999 Ono et al.
5,948,576 A 9/1999 Shirota et al. ..... 347/106
6,060,113 A 5/2000 Banno et al. ..... 427/78
6,364,450 B1 * 4/2002 Yamaguchi et al. ..... 347/33
6,497,474 B2 12/2002 Irinoda et al. ..... 347/54
6,500,485 B1 12/2002 Yamaguchi et al. ..... 427/162
6,503,116 B1 1/2003 Suzuki et al.
6,511,158 B2 1/2003 Tanaka ..... 347/54
6,596,988 B2 7/2003 Corso et al. ..... 250/288
6,629,741 B1 * 10/2003 Okuda et al. ..... 347/11
6,673,386 B2 1/2004 Komyoji et al. ..... 427/8
6,692,095 B1 2/2004 Marumoto et al.
6,839,312 B2 1/2005 Heylen et al.
2001/0028916 A1 10/2001 Akahira ..... 427/8
2002/0044163 A1 4/2002 Shigemura ..... 347/9
2002/0145639 A1 10/2002 Masuda et al.
2002/0167560 A1 * 11/2002 Fujimori ..... 347/15

FOREIGN PATENT DOCUMENTS

JP 59-75205 4/1984
JP 63-235901 9/1988

(Continued)

*Primary Examiner*—Julian D. Huffman
(74) *Attorney, Agent, or Firm*—Fitzpatrick, Cella, Harper & Scinto

(57) ABSTRACT

The amounts of liquid discharged from a liquid discharge head to predetermined areas can be made uniform while suppressing an increase in circuit size. In order to achieve this object, there is provided a liquid discharge apparatus which discharges a liquid from a liquid discharge head having a plurality of nozzles for discharging the liquid, wherein the liquid discharge head includes a subset of nozzles capable of individually controlling liquid discharge amounts, among the plurality of nozzles. The subset of nozzles is smaller in number than the total number of the plurality of nozzles.

22 Claims, 34 Drawing Sheets

FOREIGN PATENT DOCUMENTS

| | | | |
|---|---|---|---|
| JP | 1-217320 | | 8/1989 |
| JP | 2-56822 | | 2/1990 |
| JP | 5-96730 | * | 4/1993 |
| JP | 8-179110 | | 7/1996 |
| JP | 9-281324 | | 10/1997 |
| JP | 11-354015 | | 12/1999 |
| JP | 2000-043269 | | 2/2000 |
| JP | 2000-89019 | | 3/2000 |
| KR | 1998-041649 | | 8/1998 |
| KR | 2001-0082374 | | 8/2001 |
| KR | 2002-0007368 | | 1/2002 |

* cited by examiner

NOTE THAT FOREGOING CHART REPRESENTS REFERENCE EXAMPLE OF 2-PLS DRIVING
V1, V2, V3: SET DRIVING SIGNAL VOLTAGE, Δv1, Δv2 : CORRECTION VOLTAGE

LIQUID DISCHARGE METHOD AND APPARATUS USING INDIVIDUALLY CONTROLLABLE NOZZLES

FIELD OF THE INVENTION

The present invention relates to a technique of printing a predetermined pattern by using a liquid discharge head (e.g., an ink-jet head).

BACKGROUND OF THE INVENTION

In general, liquid crystal display devices are mounted in personal computers, wordprocessors, pachinko machines, vehicle navigation systems, small-size TV sets, and the like, and have recently been in increasing demand. However, liquid crystal display devices are expensive, and hence demand for cost reduction has increased year by year. Of the components of a liquid crystal display device, a color filter exhibits a high cost ratio, and demand for a reduction in the cost of the color filter has increased.

A color filter used in a liquid crystal display device is formed by arraying filter elements colored in, for example, red (R), green (G), and blue (B) on a transparent substrate. A black matrix (BM) for blocking light is provided around each filter element to improve the display contrast of the liquid crystal display device. BMs range from a BM using a Cr metal thin film to a recent resin BM using a black resin.

An overcoat layer (protective layer) made of an acrylic-based resin or epoxy-based resin and having a thickness of 0.5 to 2 μm is formed on a colored layer including a filter element to, for example, improve smoothness. A transparent electrode (ITO) film is further formed on this overcoat layer.

Various conventional methods of coloring the filter elements of a color filter are known, including, for example, a dyeing method, pigment dispersion method, electrodeposition method, and printing method.

In the dyeing method, a water-soluble polymer material as a dyeing material is formed on a glass substrate and patterned into a predetermined shape by photolithography. The obtained pattern is dipped in a dyeing solution. This process is repeated for R, G, and B to obtain color filters.

In the pigment dispersion method, a pigment-dispersed photosensitive resin layer is formed on a transparent substrate by a spin coater or the like. The resultant layer is then patterned. This process is performed once for each of R, G, and B, i.e., repeated a total of three times for R, G, and B, thereby obtaining R, G, and B color filters.

In the electrodeposition method, a transparent electrode is patterned on a substrate, and the resultant structure is dipped in an electrodeposition coating fluid containing a pigment, resin, electrolyte, and the like to be colored. This process is repeated for R, G, and B to form color filters.

In the printing method, a thermosetting resin in which a pigment-based coloring material is dispersed is colored by offset printing. This process is repeated for R, G, and B to form color filters.

The above color filter manufacturing methods have a common feature that the same process must be repeated three times to color layers in three colors, i.e., R, G, and B, and hence the cost is high. In addition, since a large number of processes are required, the yield decreases.

In order to eliminate these drawbacks, color filter manufacturing methods using an ink-jet system are disclosed in Japanese Patent Laid-Open Nos. 59-75205, 63-235901, and 1-217320. The ink-jet system is a method of forming filter elements by injecting coloring materials containing R, G, B color materials onto a transparent substrate using an ink-jet head and drying/fixing the coloring materials. In this method, since R, G, and B portions can be formed at once, simplification of the manufacturing process and a reduction in cost can be achieved. In addition, since the number of steps is smaller than those in the dyeing method, pigment dispersion method, electrodeposition method, printing method, and the like, an increase in yield can be achieved.

In a color filter used in a general liquid crystal display device, black matrix opening portions (i.e., pixels) for partitioning the respective pixels are rectangular, whereas ink droplets discharged from an ink-jet head are almost circular. It is therefore difficult to discharge ink in an amount required for one pixel at once and uniformly spread the ink in the entire opening portion of the black matrix. For this reason, a plurality of ink droplets are discharged to one pixel on a substrate to color it while the ink-jet head is scanned relative to the substrate.

As variations in the amounts of ink filled in the respective pixels are small, a high-quality color filter with reduced unevenness can be manufactured.

The amount of ink discharged from an ink-jet head may vary among nozzles even in discharge driving operation under the same discharge driving condition owing to variations in the structures of nozzles constituting the head or structures associated with discharging operation, driving mechanisms, and driving characteristics. In this case, even if the same numbers of ink droplets are discharged to the respective pixels, the amounts of ink filled in the respective pixels vary because of the use of different nozzles. The variations in the amounts of ink filled lead to unevenness among the pixels, resulting in reductions in the quality and yield of color filters.

In order to solve this problem of density unevenness, the following two methods (bit correction and shading correction) have been adopted. Consider here an ink-jet head for discharging ink using heat energy.

A method (to be referred to as bit correction hereinafter) of correcting the differences in ink discharge amount between the respective nozzles of an ink-jet head IJH, which has a plurality of ink discharge nozzles shown in FIGS. 16 to 18 as disclosed in Japanese Patent Laid-Open No. 9-281324, will be described first.

First of all, as shown in FIG. 16, ink is discharged from, for example, three nozzles, i.e., nozzle 1, nozzle 2, and nozzle 3, of the ink-jet head IJH onto a predetermined substrate P, and the sizes of ink dots formed on the substrate P by the ink discharged from the respective nozzles are detected, thereby measuring the amounts of ink discharged from the respective nozzles. In this case, the width of a heat pulse applied to the heater of each nozzle is kept constant, and the width of a pre-heat pulse is changed. With this operation, a curve like the one shown in FIG. 17 can be obtained, which represents the relationship between the pre-heat pulse width and the ink discharge amount. Assume that all the amounts of ink discharged from the respective nozzles are to be unified to 20 ng. In this case, it is obvious from the curve shown in FIG. 17 that the width of a pre-heat pulse applied to nozzle 1 is 1.0 μs; to nozzle 2, 0.5 μs; and to nozzle 3, 0.75 μs. By applying pre-heat pulses with these widths to the heaters of the respective nozzles, all the amounts of ink discharged from the respective nozzles can be unified to 20 ng, as shown in FIG. 18. Correcting the amounts of ink discharged from the respective nozzles in this manner will be referred to as bit correction.

FIGS. 19 and 20 are views showing a method (to be referred to as shading correction hereinafter) of correcting density unevenness in the scanning direction of the ink-jet head by adjusting the ink discharge density from each ink discharge nozzle. Assume that as shown in FIG. 19, when the amount of ink discharged from nozzle 3 of the ink-jet head is set as a reference, the amount of ink discharged from nozzle 1 is −10%, and that from nozzle 2 is +20%. In this case, while the ink-jet head IJH is scanned, as shown in FIG. 20, a heat pulse is applied to the heater of nozzle 1 once for nine reference clocks, a heat pulse is applied to the heater of nozzle 2 once for 12 reference clocks, and a heat pulse is applied to nozzle 3 once for 10 reference clocks. With this operation, the number of ink droplets discharged in the scanning direction is changed for each nozzle, and the ink densities in the pixels of the color filter can be made constant in the scanning direction, as shown in FIG. 20. This makes it possible to prevent density unevenness of each pixel. Correcting ink discharge density in the scanning direction in this manner will be referred to as shading correction.

As methods of reducing density unevenness, the above two methods are known. For example, in a conventional color filter colored in the respective colors in a stripe pattern like the one disclosed in Japanese Patent Laid-Open No. 8-179110, the shading method, which is the latter of the above two methods, is used to adjust the discharge pitch on a pixel array basis so as to adjust the discharge amount for one pixel array. In this striped color filter, a color mixing prevention wall is provided between color pixel arrays to prevent ink of a predetermined color discharged to one pixel array from flowing into an adjacent pixel array of a different color.

In a color filter in which no color mixing prevention wall is provided between color pixel arrays and only a BM (black matrix) is provided as a partition between pixels, unlike a color filter as described above which is colored in a stripe pattern with a color mixing prevention wall being provided between color pixel arrays, when ink is discharged in the form of a line on a pixel array basis, the ink discharged onto the water-repellent BM flows into an adjacent pixel area, resulting in difficulty in managing the amount of ink discharged into each pixel.

That is, it is difficult to control the amount of ink applied into a pixel to a predetermined amount by using a method of adjusting discharge intervals as in the above shading correction.

With an increase in the resolution of color filter pixels, the pixel area tends to decrease. This makes it more difficult to control the amount of ink filled in each pixel.

For this reason, it is important to take new measures to improve the quality of a color filter in association with density unevenness by using the method (bit correction) of making discharge amounts uniform, which is the former method of the above two density unevenness reducing methods.

For example, a technique is proposed in Japanese Patent Laid-Open No. 2000-89019, in which in order to manufacture a color filter without any color unevenness, only nozzles used to print the color filter are caused to discharge ink, the amounts of ink discharged from the nozzles are measured, and the ink discharge amounts of the nozzles are corrected. This is an effective means to eliminate unevenness between pixels by making the ink discharge amounts for printing uniform.

FIG. 22 shows an example of a discharge amount control circuit serving as a discharge amount individual control device for making the discharge amounts of the respective nozzles uniform. In this discharge amount individual control device, a head nozzle driving circuit 304 is provided for each nozzle to adjust the amount of ink discharged from each nozzle. However, in the form in which the head nozzle driving circuits 304 are provided in number equal to the number of nozzles, as the number of nozzles increases, the number of head nozzle driving circuits 304 increases, resulting in increases in circuit size and cost. In the case of industrial printing apparatuses for color filters, which are required to perform mass production, a considerably large number of nozzles are required as compared with home printers, and hence a large number head nozzle driving circuits 304 must be provided. This leads to increases in circuit size, cost, and control load.

As shown in FIG. 22, an electric wire (cable) is used to connect the head nozzle driving circuit 304 to a head 303. If this cable is shorter than an allowable length, noise is superimposed on the cable, or the driving voltage is attenuated. In order to prevent the generation of noise or the attenuation of driving power, the head nozzle driving circuit 304 must be located at a position where the cable connecting the head nozzle driving circuit to the head 303 falls within the allowable length.

This in turn poses a problem in terms of apparatus design, that is, a head nozzle control circuit is too large to be mounted.

In addition, if all nozzles are designed to individually control their discharge amounts, the circuit size of a print control unit 311 also increases.

Furthermore, an increase in overall apparatus size poses problems in terms of difficulty in handling, an increase in consumption power, and an increase in the cost of the apparatus.

In the above description, a color filter has been exemplified as an object to be manufactured. However, the above problems arise not only in the manufacture of color filters but also in a case wherein the amount of liquid applied to a predetermined area (pixel) on a substrate must be controlled to a predetermined amount. For example, such problems arise in a case wherein a predetermined amount of EL (electroluminescence) material liquid is applied from a liquid discharge head (ink-jet head) to a predetermined area on a substrate to manufacture an EL display device. In addition, similar problems arise in a case wherein a predetermined amount of conductive thin film material liquid (liquid containing a metal element) is applied to a predetermined area on a substrate to manufacture an electron-emitting device obtained by forming a conductive thin film on a substrate or a display panel including a plurality of such devices.

SUMMARY OF THE INVENTION

The present invention has, therefore, been made in consideration of the above problems, and has as its object to control the amounts of liquid applied to predetermined areas (pixels) on a substrate to a predetermined amount so as to make the amounts of liquid applied to the predetermined areas (pixels) uniform while suppressing an increase in the circuit size of a liquid discharge amount control circuit (e.g., an ink discharge amount control circuit).

This makes the amounts of liquid filled in the respective predetermined areas (pixels) uniform, thereby manufacturing a high-quality color filter with each pixel satisfying a required characteristic, a display device panel such as an EL display device, an electron-emitting device, and a display panel using the electron-emitting device.

In order to solve the above problems and achieve the above object, according to the first aspect of the present invention, there is provided a liquid discharge apparatus which discharges a liquid from a liquid discharge head having a plurality of nozzles for discharging the liquid, characterized in that the liquid discharge head includes nozzles capable of individually controlling liquid discharge amounts, among the plurality of nozzles, which are smaller in number than the total number of the plurality of nozzles.

According to the second aspect of the present invention, there is provided a liquid discharge apparatus which discharges a liquid from a liquid discharge head having a plurality of nozzles for discharging the liquid, characterized in that the liquid discharge head includes a nozzle connected to a discharge amount control device which changeably sets a liquid discharge amount, and a nozzle which is not connected to the discharge amount control device.

According to the third aspect of the present invention, there is provided a liquid discharge apparatus which discharges a liquid from a liquid discharge head having a plurality of nozzles for discharging the liquid, characterized in that the liquid discharge head includes a nozzle capable of changing a liquid discharge amount and a nozzle incapable of changing a liquid discharge amount.

According to the fourth aspect of the present invention, there is provided a liquid discharge method of discharging a liquid from a liquid discharge head having a plurality of nozzles for discharging the liquid, characterized in that the liquid discharge head including nozzles capable of individually controlling liquid discharge amounts, among the plurality of nozzles, which are smaller in number than the total number of the plurality of nozzles is used to discharge a liquid from the liquid discharge head to a substrate.

According to the fifth aspect of the present invention, there is provided a liquid discharge method of discharging a liquid from a liquid discharge head having a plurality of nozzles for discharging the liquid, characterized in that the liquid discharge head including a nozzle connected to a discharge amount control device which changeably sets a liquid discharge amount, and a nozzle which is not connected to the discharge amount control device is used to discharge a liquid from the liquid discharge head to a substrate.

According to the sixth aspect of the present invention, there is provided a liquid discharge method of discharging a liquid from a liquid discharge head having a plurality of nozzles for discharging the liquid, characterized in that the liquid discharge head including a nozzle capable of changing a liquid discharge amount and a nozzle incapable of changing a liquid discharge amount is used to discharge a liquid from the liquid discharge head to a substrate.

According to the seventh aspect of the present invention, there is provided a display device panel manufacturing apparatus which uses a liquid discharge head having a plurality of nozzles for discharging a liquid and manufactures a display device panel by discharging the liquid from the liquid discharge head onto a substrate, characterized in that the liquid discharge head includes nozzles capable of individually controlling liquid discharge amounts, among the plurality of nozzles, which are smaller in number than the total number of the plurality of nozzles.

According to the eighth aspect of the present invention, there is provided a display device panel manufacturing apparatus which uses a liquid discharge head having a plurality of nozzles for discharging a liquid and manufactures a display device panel by discharging the liquid from the liquid discharge head onto a substrate, characterized in that the liquid discharge head includes a nozzle connected to a discharge amount control device which changeably sets a liquid discharge amount, and a nozzle which is not connected to the discharge amount control device.

According to the ninth aspect of the present invention, there is provided a display device panel manufacturing apparatus which uses a liquid discharge head having a plurality of nozzles for discharging a liquid and manufactures a display device panel by discharging the liquid from the liquid discharge head onto a substrate, characterized in that the liquid discharge head includes a nozzle capable of changing a liquid discharge amount and a nozzle incapable of changing a liquid discharge amount.

According to the 10th aspect of the present invention, there is provided a display device panel manufacturing method which uses a liquid discharge head having a plurality of nozzles for discharging a liquid and manufactures a display device panel by discharging the liquid from the liquid discharge head onto a substrate, characterized in that a display device panel is manufactured by discharging, onto the substrate, a liquid from the liquid discharge head including nozzles capable of individually controlling liquid discharge amounts, among the plurality of nozzles, which are smaller in number than the total number of the plurality of nozzles. In this case, the display device panel includes a color filter, an EL display device, and a panel used for a display device, such as a display panel including electron-emitting devices.

According to the 11th aspect of the present invention, there is provided a display device panel manufacturing method which uses a liquid discharge head having a plurality of nozzles for discharging a liquid and manufactures a display device panel by discharging the liquid from the liquid discharge head onto a substrate, characterized in that a display device panel is manufactured by discharging, onto the substrate, a liquid from the liquid discharge head including a nozzle connected to a discharge amount control device which changeably sets a liquid discharge amount, and a nozzle which is not connected to the discharge amount control device.

According to the 12th aspect of the present invention, there is provided a display device panel manufacturing method which uses a liquid discharge head having a plurality of nozzles for discharging a liquid and manufactures a display device panel by discharging the liquid from the liquid discharge head onto a substrate, characterized in that a display device panel is manufactured by discharging, onto the substrate, a liquid from the liquid discharge head including a nozzle capable of changing a liquid discharge amount and a nozzle incapable of changing a liquid discharge amount.

In the above arrangement, discharge amount control devices (voltage control devices capable of changing driving voltages or pulse control devices capable of changing driving pulses) capable of changing the discharge amounts of nozzles are provided in a smaller number than nozzles instead of being provided in correspondence with the respective nozzles. This allows to use a discharge amount control device with a small circuit size. Since this arrangement includes discharge amount unchangeable nozzles which are not connected to any discharge amount control device (voltage control device or pulse control device) and cannot change discharge amounts and discharge amount changeable nozzles which are connected to discharge amount control devices (voltage control devices and pulse control devices) and can change discharge amounts, it is only required to adjust the amounts of liquid discharged from the above discharge amount changeable nozzles when adjusting the amounts of liquid discharged to predetermined areas (pixels). This makes it possible to control the amounts of liquid filled in the predetermined areas (pixels).

In the present invention, as a liquid discharge head, an ink-jet head is used. However, a liquid other than ink may be discharged depending on the object to be manufactured. For example, if the object to be manufactured is a color filter, an EL material liquid is discharged if the object to be manufactured is an EL device. Likewise, if the object to be manufactured is an electron-emitting device, a conductive thin film material liquid is discharged. As described above, the liquid discharge head defined in this specification includes a head for discharging a liquid other than ink. However, since an ink-jet system is used as a discharge system, even a liquid discharge head which discharges a liquid other than ink may be termed an ink-jet head.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

A preferred embodiment of the present invention will be described below with reference to the accompanying drawings.

Note that a display device panel defined in the present invention is a panel used for a display device, including, for example, a display panel including a plurality of color filters having colored portions, EL devices having light-emitting portions formed of a spontaneous emission material (EL material), or electron-emitting devices having conductive thin film portions.

A color filter defined in the present invention is a filter comprised of colored portions and base members and capable of obtaining output light upon changing the characteristics of input light. More specifically, in a liquid crystal display device, backlight light is transmitted through such a color filter to obtain light of the three primary colors, i.e., R, G, and B or C, M, or Y, from the backlight light. Note that the base member in this case includes a substrate made of a glass or plastic material or the like, and also includes a member having a shape other than a plate-like shape.

Figure 1:
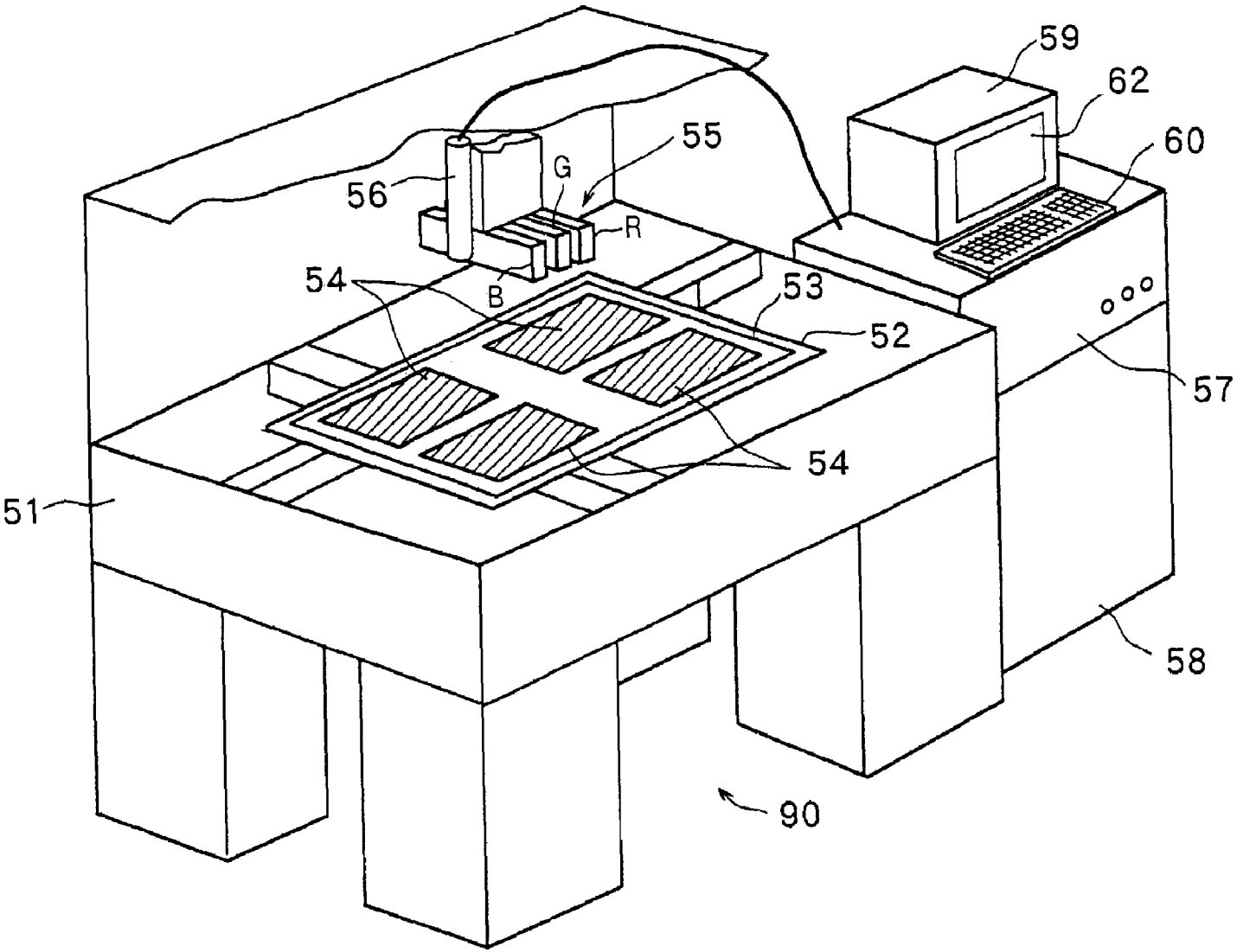
FIG. 1 is a perspective view showing the arrangement of an embodiment of a color filter manufacturing apparatus.

FIG. 1 is a schematic view showing the arrangement of a color filter manufacturing apparatus according to an embodiment.

Referring to FIG. 1, reference numeral 51 denotes an apparatus base; 52, an X-Y-θ stage disposed on the apparatus base 51; 53, a color filter substrate set on the X-Y-θ stage 52; 54, color filters formed on the color filter substrate 53; 55, red, green, and blue ink-jet heads for coloring the color filters 54; 58, a controller for controlling the overall operation of a color filter manufacturing apparatus 90; 59, a teaching pendant (personal computer) serving as the display unit of the controller; and 60, a keyboard serving as the operation unit of the teaching pendant 59.

Figure 2:
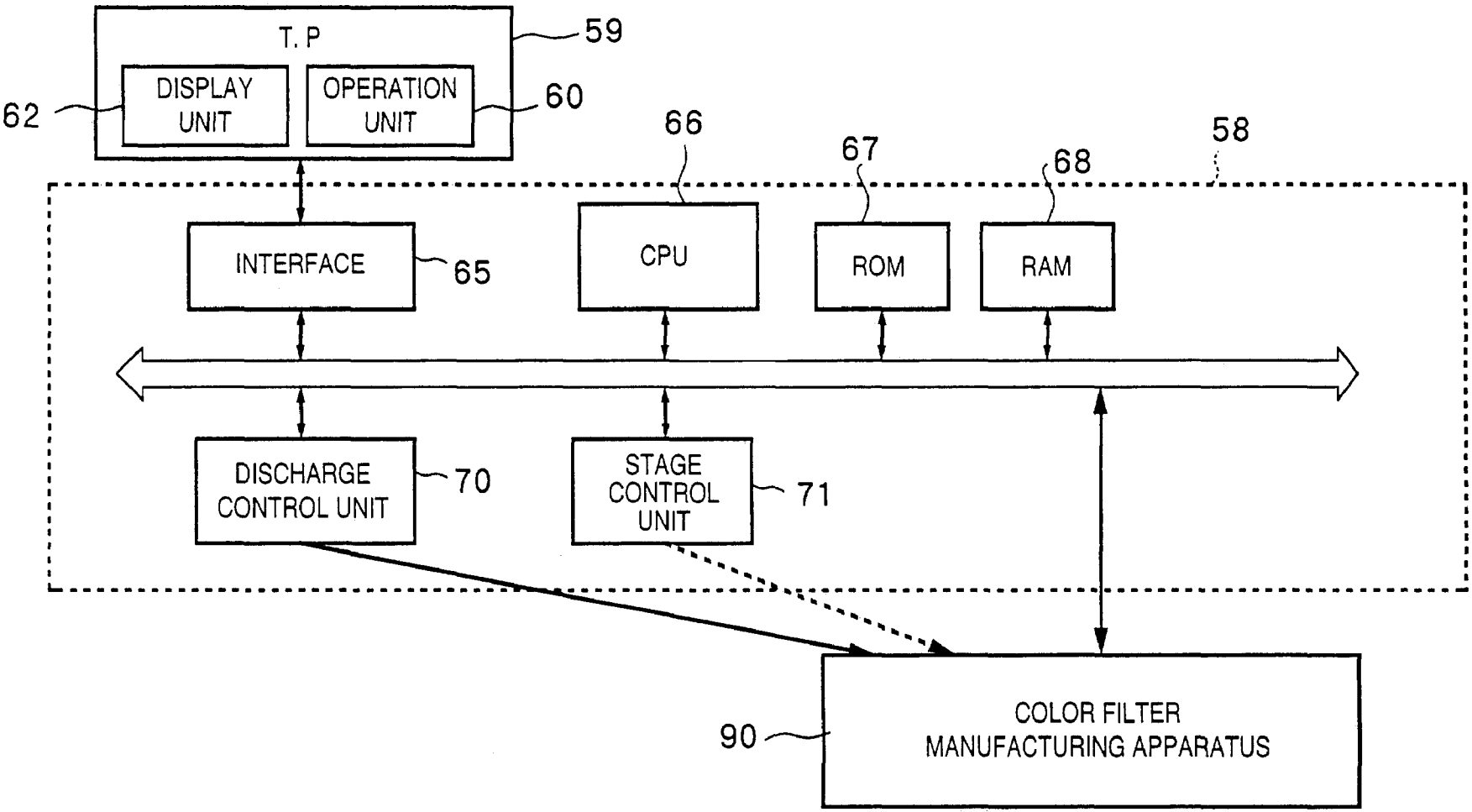
FIG. 2 is a block diagram showing the arrangement of a control unit for controlling the operation of the color filter manufacturing apparatus.

FIG. 2 is a block diagram showing the arrangement of the controller of the color filter manufacturing apparatus 90. Reference numeral 59 denotes the teaching pendant serving as the input/output device of the controller 58; and 62, a display unit for displaying how a manufacturing process progresses, information indicating the presence/absence of a head abnormality, and the like. The operation unit (keyboard) 60 provides an instruction for operation of the color filter manufacturing apparatus 90 and the like.

The controller 58 controls the overall operation of the color filter manufacturing apparatus 90. Reference numeral 65 denotes an interface for exchanging data with the teaching pendant 59; 66, a CPU for controlling the color filter manufacturing apparatus 90; 67, a ROM storing control programs for operating the CPU 66; 68, a RAM for storing production information and the like; 70, a discharge control unit for controlling discharging of ink into each pixel of a color filter; and 71, a stage control unit for controlling the operation of the X-Y-θ stage 52 of the color filter manufacturing apparatus 90. The color filter manufacturing apparatus 90 is connected to the controller 58 and operates in accordance with instructions therefrom.

Figure 3:
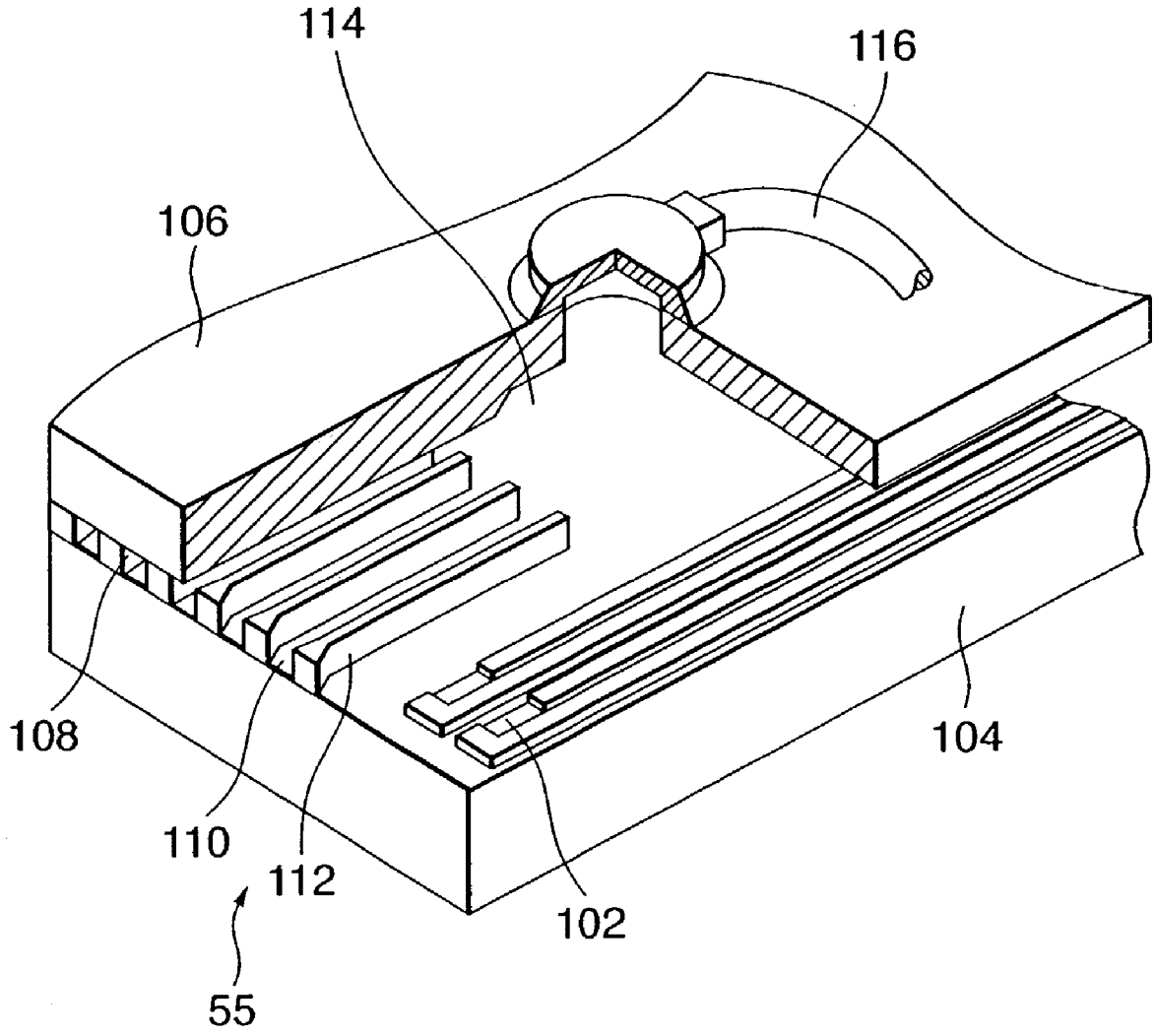
FIG. 3 is a perspective view showing the structure of an ink-jet head used in the color filter manufacturing apparatus.

FIG. 3 is a view showing the general structure of an ink-jet head IJH.

In the apparatus shown in FIG. 1, the three ink-jet heads 55 are arranged in correspondence with three colors, i.e., R, G, and B. Since these three heads have the same structure, FIG. 3 shows the structure of one of the three heads as a representative.

Referring to FIG. 3, the ink-jet head IJH is mainly comprised of a heater board 104 as a board on which a plurality of heaters 102 for heating ink are formed, and a ceiling plate 106 mounted on the heater board 104. A plurality of orifices 108 are formed in the ceiling plate 106. Tunnel-like liquid channels 110 communicating with the orifices 108 are formed therebehind. The respective liquid channels 110 are isolated from the adjacent liquid channels via partition walls 112. The respective liquid channels 110 are commonly connected to one ink chamber 114 at the rear side of the liquid channels. Ink is supplied to the ink chamber 114 via an ink inlet 116. This ink is supplied from the ink chamber 114 to each liquid channel 110.

The heater board 104 and the ceiling plate 106 are positioned such that the position of each heater 102 coincides with that of a corresponding liquid channel 110, and are assembled into the state shown in FIG. 3. Although FIG. 3 shows only two heaters 102, one heater is arranged in correspondence with each liquid channel 110. When a predetermined driving pulse is supplied to one of the heaters 102 in the assembled state shown in FIG. 3, ink above the heater 102 boils to produce a bubble, and the ink is pushed and discharged from the orifice 108 upon volume expansion of the ink. Therefore, the size of a bubble can be adjusted by controlling a driving pulse applied to the heater 102, thereby controlling the volume of the ink discharged from each orifice. Parameters for control include, for example, power to be supplied to the heaters.

Figure 4:
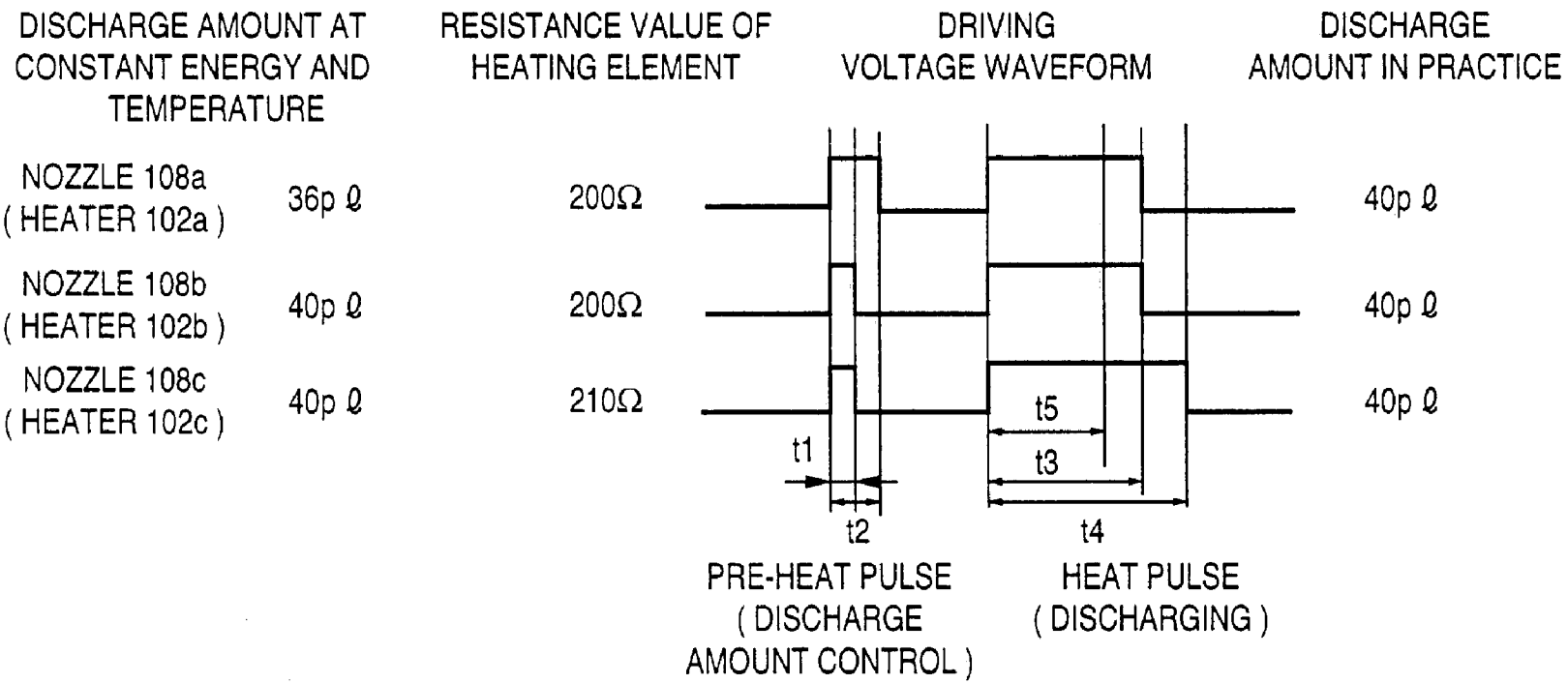
FIG. 4 is a view showing the waveforms of voltages applied to a heater of the ink-jet head.

FIG. 4 is a view for explaining a method of controlling the amount of ink discharged by changing the power to be supplied to a heater in this manner.

To adjust the amount of ink discharged, two kinds of low-voltage pulses are applied to the heater 102. As shown in FIG. 4, the two kinds of pulses are a pre-heat pulse and a main heat pulse (to be simply referred to as a heat pulse hereinafter). The pre-heat pulse is used to heat ink to a predetermined temperature before the ink is actually discharged. This pulse is set to a value shorter than a minimum pulse width t5 required to discharge ink. No ink is therefore discharged by this pre-heat pulse. A pre-heat pulse is applied to the heater 102 in advance to raise the initial temperature of ink to a predetermined temperature so as to keep the ink discharge amount always constant when a constant heat pulse is applied to the heater afterward. In contrast to this, the temperature of ink may be adjusted in advance by adjusting the length of a pre-heat pulse so as to change the amount of ink discharged even when the same heat pulse is applied to the heater. In addition, heating ink before application of a heat pulse will shorten the rise time for ink discharging operation upon application of a heat pulse, thereby improving the response.

A heat pulse is a pulse used to actually discharge ink, and set to a value longer than the minimum pulse width t5 required to discharge ink. The energy generated by the heater 102 is proportional to the width (application time) of a heat pulse. Variations in the characteristics of the heaters 102 can therefore be adjusted by adjusting the width of the heat pulse.

Note that controlling the diffused state of heat generated by a pre-heat pulse by adjusting the interval between the pre-heat pulse and a heat pulse can also adjust the amount of ink discharged.

As is obvious from the above description, the amount of ink discharged can be adjusted by adjusting the application times of a pre-heat pulse and heat pulse or by adjusting the application interval between a pre-heat pulse and a heat pulse. Therefore, the amount of ink discharged or the response of ink discharging operation with respect to an applied pulse can be arbitrarily adjusted by adjusting the application times of a pre-heat pulse and heat pulse or adjusting the application interval between a pre-heat pulse and a heat pulse as needed. In coloring a color filter, in particular, in order to suppress the occurrence of color unevenness, it is preferable that the coloring density (color density) between the respective filter elements or within one filter element be made almost uniform. For this purpose, the amount of ink discharged from each nozzle may be controlled to be uniform. If the amounts of ink discharged from the respective nozzles are the same, since the amounts of ink landed on the respective filter elements become the same, the coloring density between the filter elements can be made almost uniform. This can also reduce density unevenness within one filter element. Therefore, in order to adjust the amounts of ink discharged from the respective nozzles to the same amount, the above control for ink discharge amounts is done.

FIGS. 5A to 5F are views showing a manufacturing process for a color filter. The manufacturing process for the color filter 54 will be described with reference to FIGS. 5A to 5F.

Figure 5A:
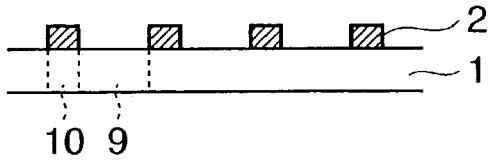
FIGS. 5A to 5F are views showing a manufacturing process for a color filter.
Figure 5B:
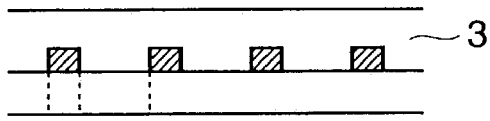
Figure 5C:
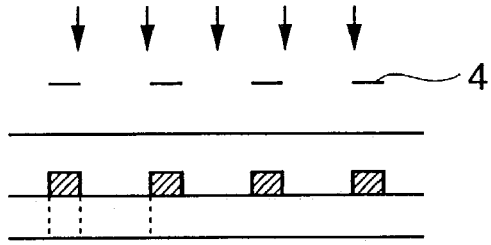

FIG. 5A shows a glass substrate 1 having a black matrix 2 forming light-transmitting portions 9 and light-shielding portions 10. A resin composition layer 3 is formed by coating the surface of the substrate 1, on which the black matrix 2 is formed, with a resin composition which is rich in ink receptivity by itself but decreases in ink receptivity under a certain condition (e.g., irradiation with light or irradiation with light and heat), and cures under a certain condition, and pre-baking the coating as needed (FIG. 5B). The resin composition layer 3 can be formed by a coating method such as spin coating, roller coating, bar coating, spraying, or dipping, and the present invention is not limited to them.

Figure 5D:
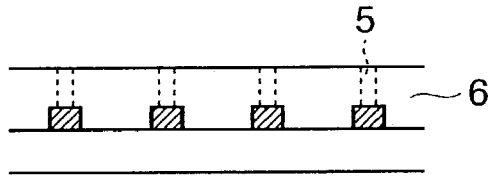

Pattern exposure is then performed on the resin layer on the light-transmitting portions 9 by using a photomask 4 to partly decrease the ink receptivity of the resin layer (FIG. 5C), thereby forming ink-receiving portions 6 and portions 5 with reduced ink receptivity in the resin composition layer 3 (FIG. 5D). In discharging ink while scanning the ink-jet head relative to the substrate a plurality of number of times, the ink-jet head may be fixed while the substrate is moved, or vice versa.

Figure 5E:
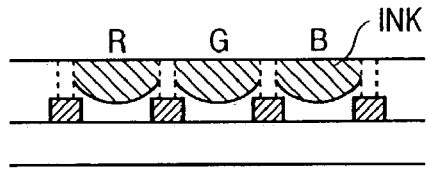

The resin composition layer 3 is then colored at once by discharging R (red), G (green), and B (blue) inks thereto by an ink-jet system, and the respective inks are dried as needed (FIG. 5E). The ink-jet system includes a system using heat energy and a system using mechanical energy. Either system can be suitably used. Inks to be used are not specifically limited as long as they can be used for the ink-jet system. As coloring agents for the inks, agents suited for transmission spectra required for R, G, and B pixels are properly selected from various kinds of dyes or pigments. Although ink discharged from the ink-jet head may adhere to the resin composition layer 3 in the form of a droplet, ink preferably adheres to the layer in the form of a column instead of being separated from the ink-jet head in the form of a droplet.

Figure 5F:
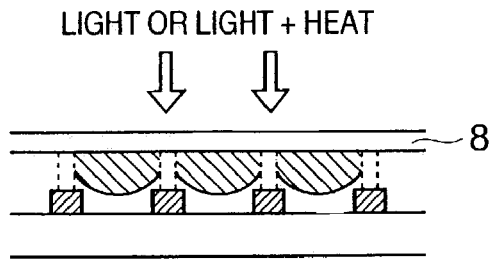

The colored resin composition layer 3 is cured by irradiation of light or irradiation of light and a heat treatment, and a protective layer 8 is formed as needed (FIG. 5F). The resin composition layer 3 can be cured under a condition different from that for the above ink repellency treatment, for example, increasing the exposure amount in performing irradiation of light, making the heating condition stricter, or performing both irradiation of light and a heat treatment.

Figure 6:
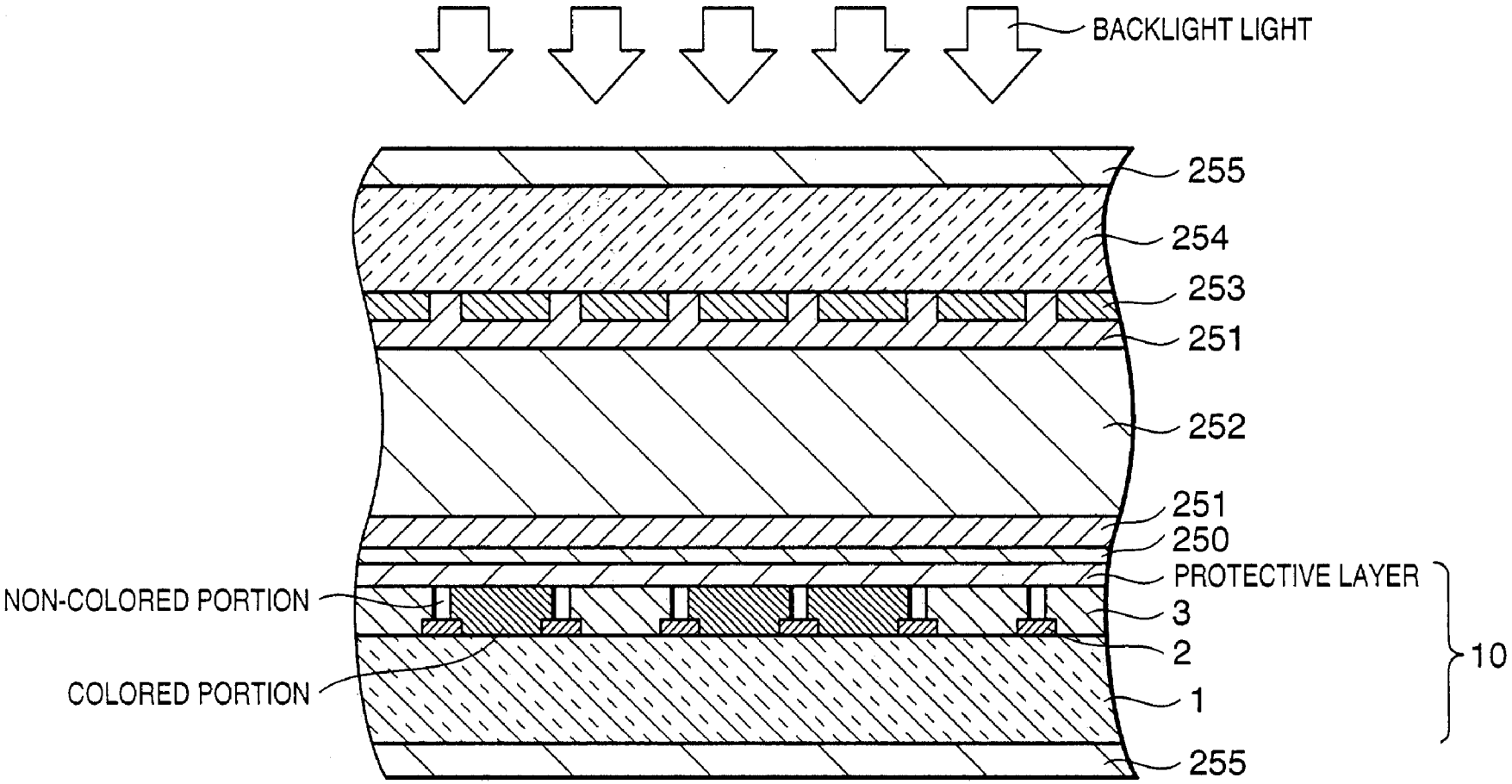
FIG. 6 is a sectional view showing the basic arrangement of a color liquid crystal display device incorporating a color filter according to an embodiment.
Figure 7:
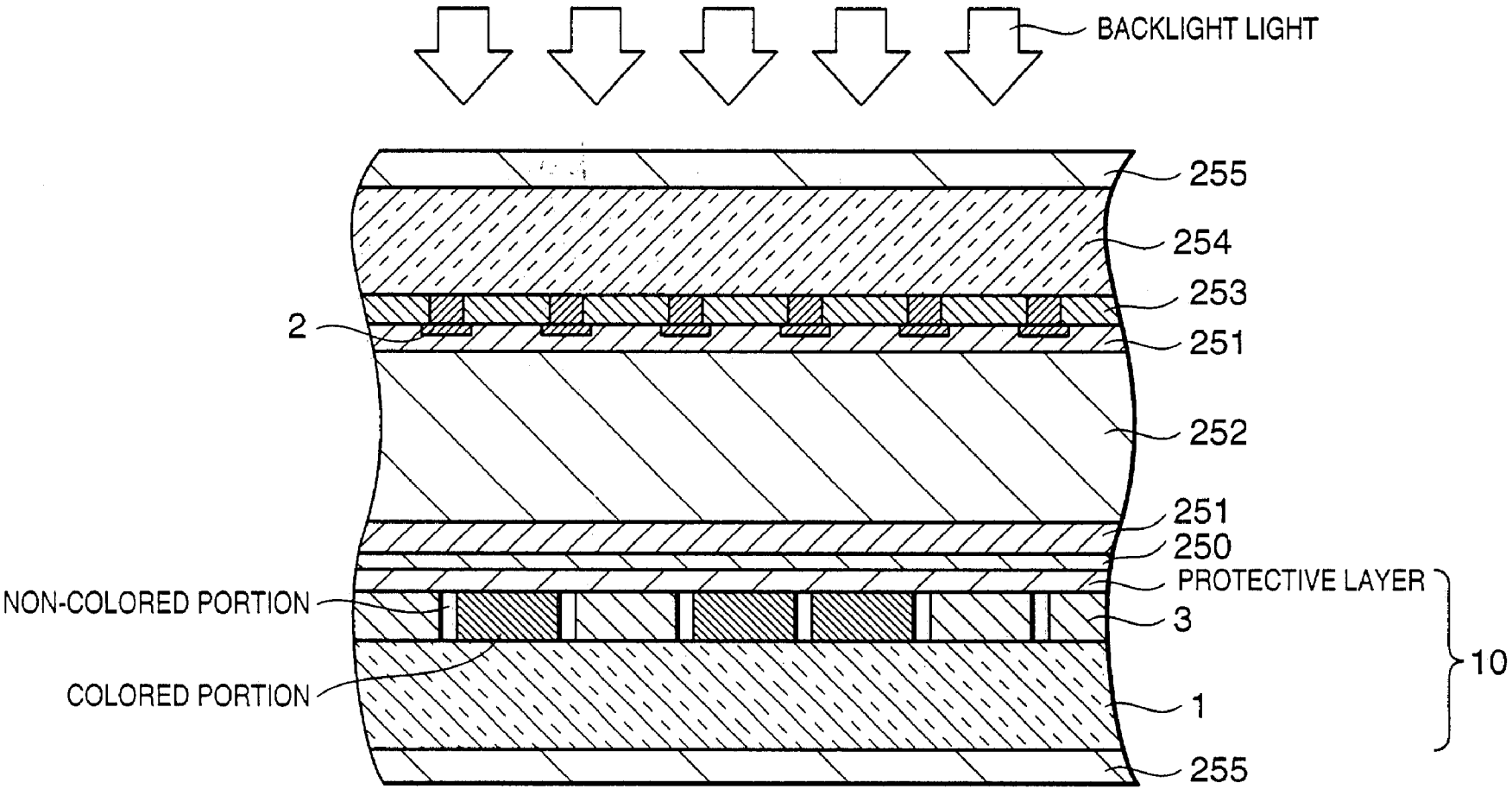
FIG. 7 is a sectional view showing the basic arrangement of a color liquid crystal display device incorporating a color filter according to a modification to the embodiment.

FIGS. 6 and 7 are sectional views showing the basic structure of a color liquid crystal display device 30 incorporating the above color filter.

A color liquid crystal display device is generally formed by joining the color filter substrate 1 and a counter substrate 254 together, and sealing a liquid crystal compound 252 therebetween. TFTs (Thin Film Transistors) (not shown) and transparent pixel electrode 253 are formed on the inner surface of one substrate 21 of the liquid crystal display device in the form of a matrix. The color filter 10 is placed on the inner surface of the other substrate 1 such that R, G, and B coloring materials are positioned to oppose the pixel electrodes. A transparent counter electrode (common electrode) 250 is formed on the entire surface of the color filter. The black matrix 2 is generally formed on the color filter substrate 1 side (see FIG. 6). However, in a BM (Black Matrix) on-array type liquid crystal panel, such a black matrix is formed on the TFT substrate side opposing the color filter substrate (see FIG. 7). Aligning films 251 are formed within the planes of the two substrates. By performing a rubbing process for the aligning films, the liquid crystal molecules can be aligned in a predetermined direction. Polarizing plates 255 are bonded to the outer surfaces of the respective glass substrates. The liquid crystal compound 252 is filled in the gap (about 2 to 5 μm) between these glass substrates. As a backlight, a combination of a fluorescent lamp (not shown) and a scattering plate (not shown) is generally used. Displayed operation is performed by causing the liquid crystal compound to serve as an optical shutter for changing the transmittance for light emitted from the backlight.

Figure 22:
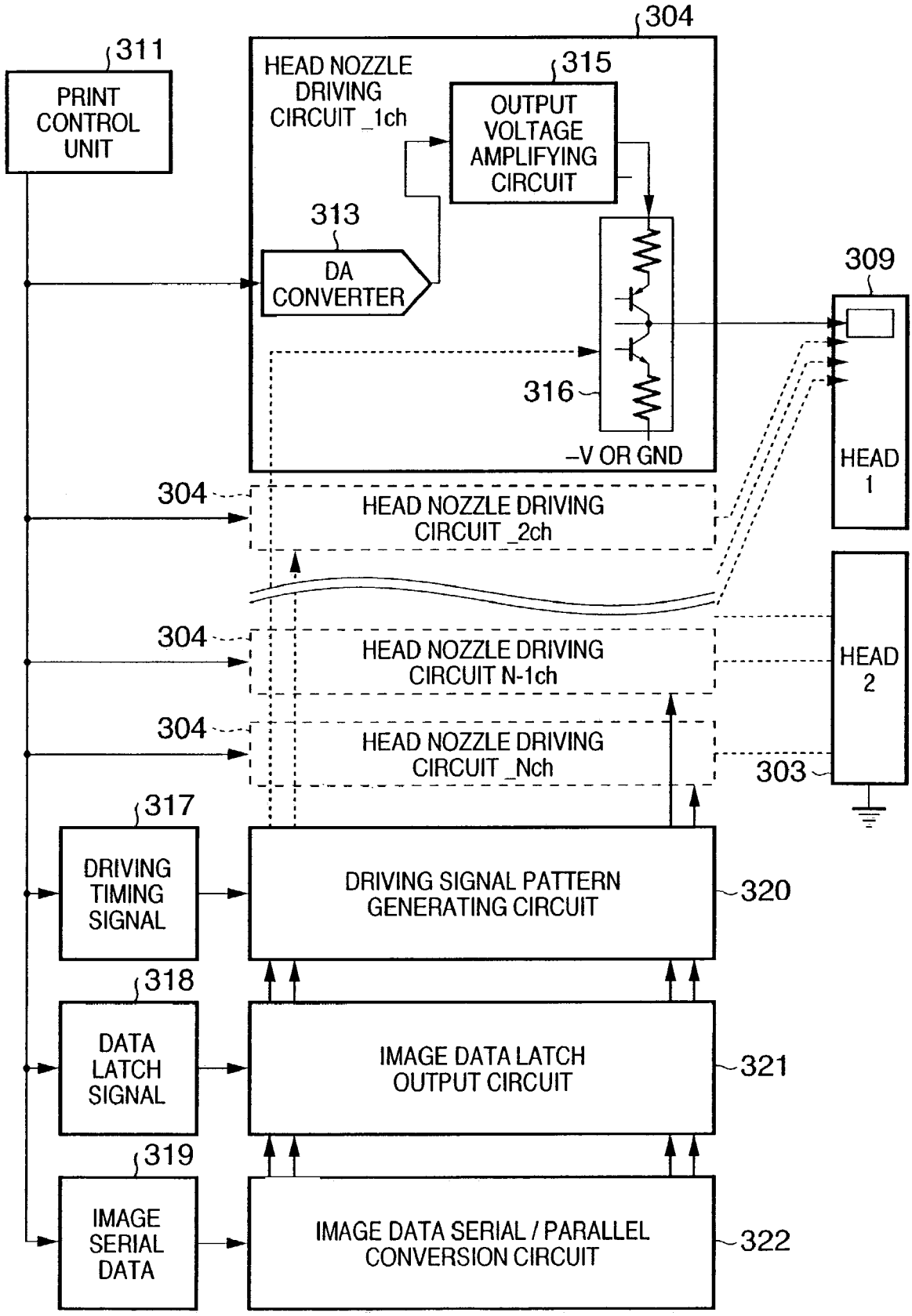
FIG. 22 is a block diagram showing the arrangement of an example of a discharge control circuit.

FIG. 22 shows the arrangement of a discharge amount control circuit. Referring to FIG. 22, all nozzles are connected to voltage control devices (including DA converters and amplifying circuits) to serve as discharge amount changeable nozzles (discharge amount individual control nozzles). In contrast to this, as will be described later, this embodiment includes nozzles (discharge amount individual control nozzles) which are connected to voltage control devices (DA converters and amplifying circuits) and nozzles (discharge amount non-control nozzle) which are not connected to such devices. This embodiment therefore differs from the arrangement shown in FIG. 22 in this point. However, since the arrangement of the embodiment is almost the same as that shown in FIG. 22 except for this point, a discharge amount control method will be briefly described below with reference to FIG. 22.

Referring to FIG. 22, a print control unit 311 supplies image serial data 319 to an image data serial/parallel conversion circuit 322, a data latch signal 318 to an image data latch output circuit 321, and a driving timing signal 317 to a driving signal pattern generating circuit 320. The print control unit 311 supplies a set control voltage command (equivalent to a command signal 1 in FIG. 8) to a head nozzle driving circuit 304. Discharge amount control is performed on the basis of various kinds of signals from the print control unit 311. More specifically, first of all, the image serial data 319 for selecting charging or non-charging of the nozzle for each channel is converted into parallel data by the image data serial/parallel conversion circuit 322. This data is latched by the image data latch output circuit 321 in response to the data latch signal 318. The nozzle of each channel is selected on the basis of this latched data. The driving signal pattern generating circuit 320 then supplies the driving timing signal 317 to the head nozzle driving circuit 304. The head nozzle driving circuit 304 supplies a driving signal to a discharge driving element 309 of the nozzle for the selected channel. Note that each discharge driving element is equivalent to a heater in a bubble-jet head. In a piezoelectric head, this element is equivalent to a piezoelectric element used on a discharge driving side wall of the ink chamber of a nozzle.

The above discharge amount control circuit performs discharge amount control by controlling the voltage of a driving signal supplied to each nozzle. This voltage control is performed by the head nozzle driving circuit 304. The head nozzle driving circuit 304 includes a DA converter 313, output voltage amplifying circuit 315, and output charging/discharging circuit 316. The DA converter 313 sets a print control voltage for each nozzle upon reception of a set control voltage value command from the print control unit 311.

The output voltage amplifying circuit 315 amplifies the voltage and current of a print control voltage and outputs a print voltage proportional to the print control voltage. The output voltage amplifying circuit 315 then applies this voltage to the output charging/discharging circuit 316. The output charging/discharging circuit 316 is a push-pull type circuit. The output charging/discharging circuit 316 is driven by an amount corresponding to the voltage set by the output voltage amplifying circuit in synchronism with a drive timing signal from the driving signal pattern generating circuit 320. When a driving signal is set at high level, the upper and lower transistors of the output charging/discharging circuit 316 are turned on and off, respectively. As a consequence, a current is output. When the driving signal is set at low level, the upper and lower transistors of the output charging/discharging circuit 316 are turned off and on, respectively. As a consequence, a current is sunk.

With the above operation, a corrected driving signal is supplied from the output charging/discharging circuit 316 to each nozzle of the head to control the amount of ink discharged from each nozzle. Note that the head nozzle driving circuit 304 for voltage control is designed to change the voltage value of a driving signal, and hence can be referred to as a transformation circuit.

Figure 23:
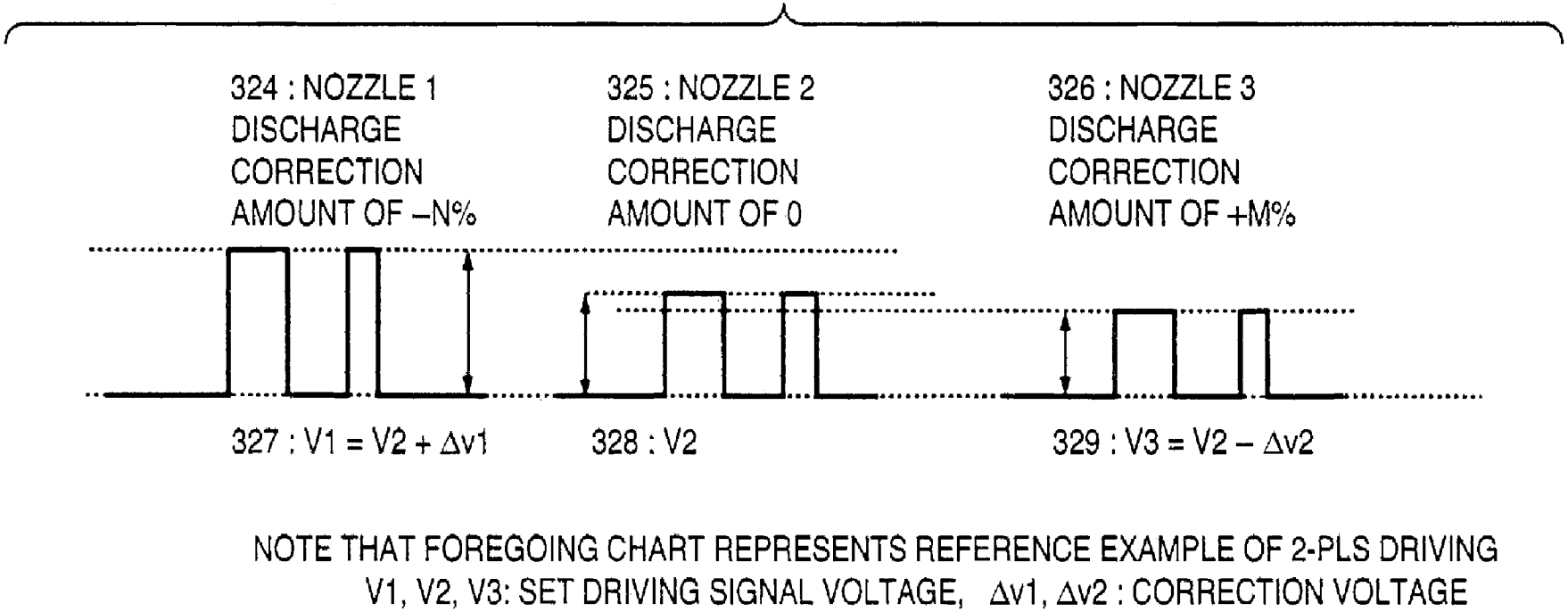
FIG. 23 is a view for briefly explaining the operation of changing the voltage of a driving signal.
Figure 24A:
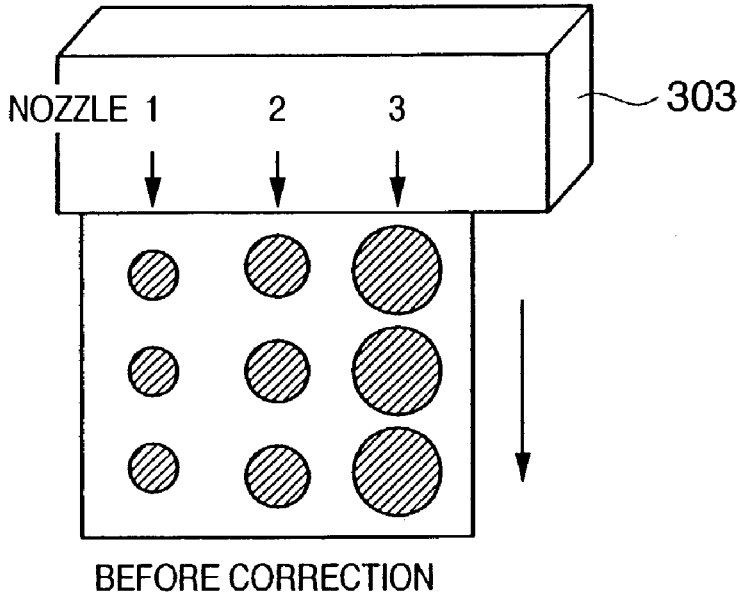
FIGS. 24A and 24B are views for explaining how ink is discharged before and after discharge amount correction.
Figure 24B:
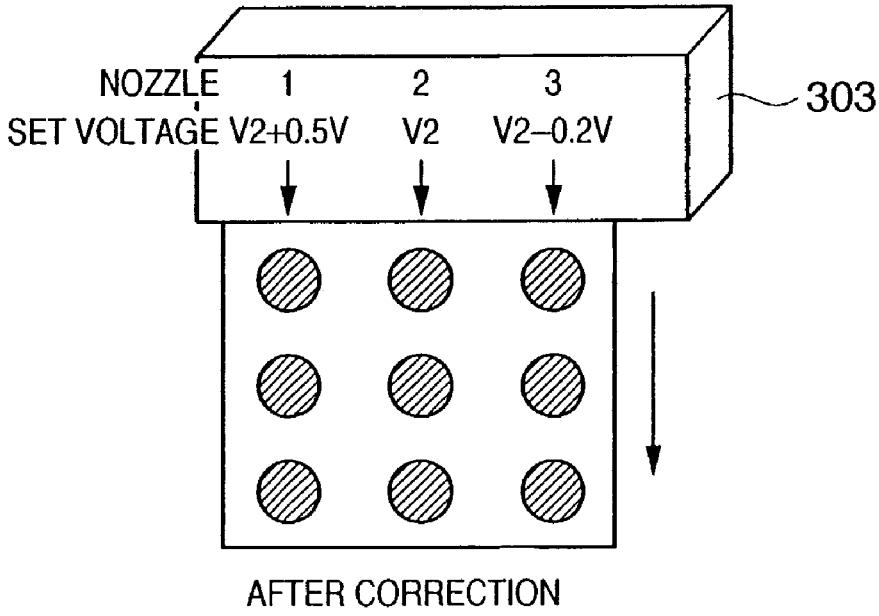

FIG. 23 shows a case wherein the voltage value of, a driving signal to be supplied to each nozzle (nozzles 1 to 3) is corrected. FIGS. 24A and 24B respectively show printed states before and after driving voltages are corrected. The states of arbitrary nozzle 1 (324), nozzle 2 (325), and nozzle 3 (326) correspond to "before correction" in FIG. 24A. Referring to FIG. 24A, the discharge amount of nozzle 2 is equal to a target discharge amount, the discharge amount of nozzle 1 is smaller than the target discharge amount, and the discharge amount of nozzle 3 is larger than the target discharge amount.

As the voltages of driving signals to be supplied to the respective nozzles, a driving voltage ($V2+\Delta v1$) corrected to be higher than a driving voltage V2 for nozzle 2 (325) by $\Delta v1$ is applied to nozzle 1, and a driving voltage ($V2-\Delta v2$) corrected to be lower than the driving voltage V2 for nozzle 2 (325) by $\Delta v2$ is applied to nozzle 3 (326).

The discharge amount states set by voltage correction in the above manner correspond to "after correction" in FIG. 24B.

Figure 25:
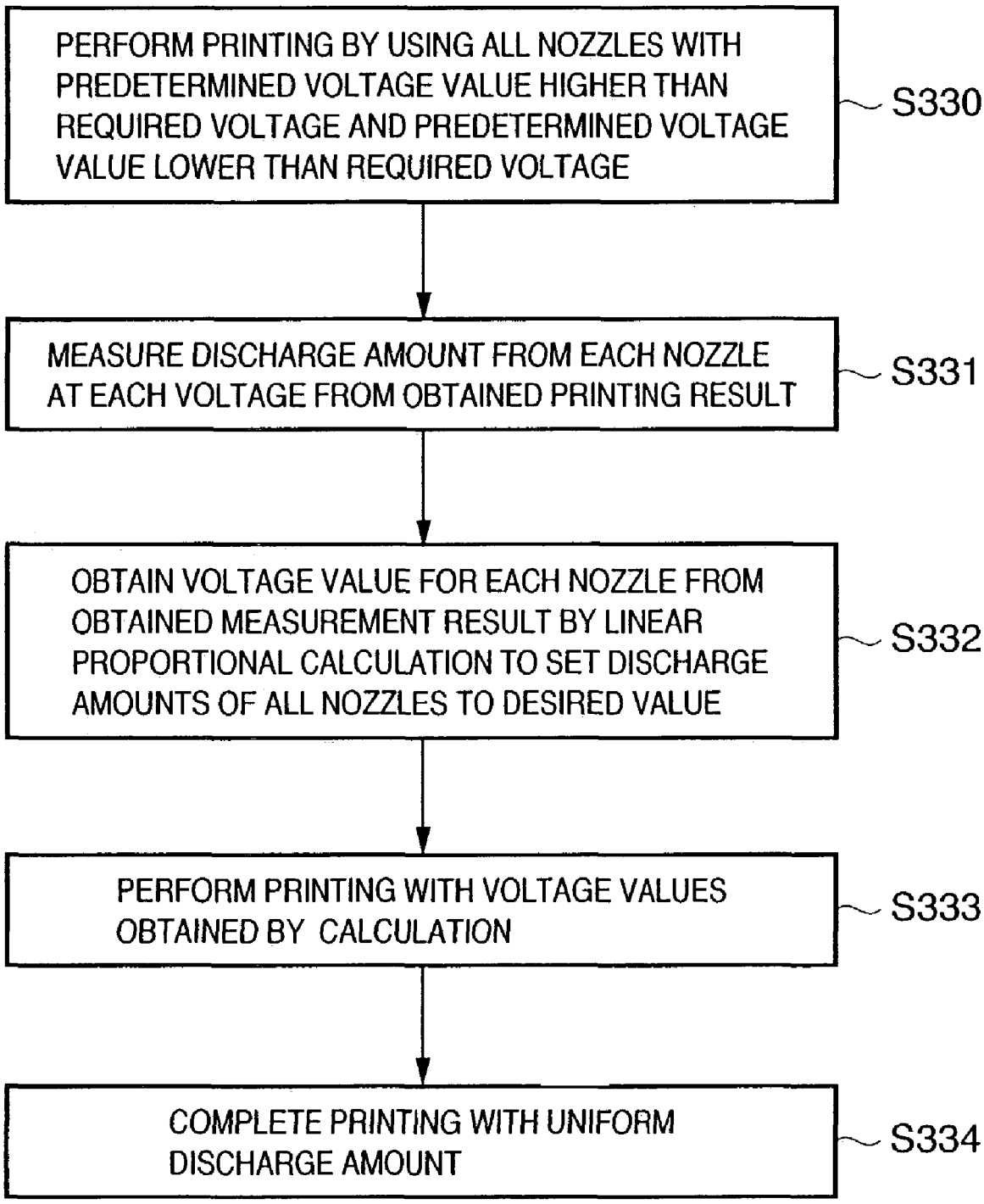
FIG. 25 is a flow chart for explaining a discharge amount correction sequence.

FIG. 25 shows a discharge amount uniformization printing sequence for making the discharge amounts of the respective nozzles uniform.

As shown in FIG. 25, each nozzle is driven by predetermined voltages higher and lower than the voltage required to obtain a given discharge amount, and ink is discharged from each nozzle to print an ink dot on a glass substrate. This operation is executed for all the nozzles (step S330).

The amount of light transmitted through each ink dot printed on the glass substrate is measured, and each ink discharge amount is obtained on the basis of the measurement result (step S331).

The voltage values of the respective nozzles which are required to set the amount of ink discharged from all the nozzles to a desired value are calculated by linear proportional calculation on the basis of the large amount of ink discharged to print, based on the large voltage value, and the small amount of ink discharged to print, based on the small voltage value (step S332). This calculation result is shown in FIG. 26 (to be described later).

Printing is then performed using the voltage values obtained by the calculation (step S333).

Figure 26:
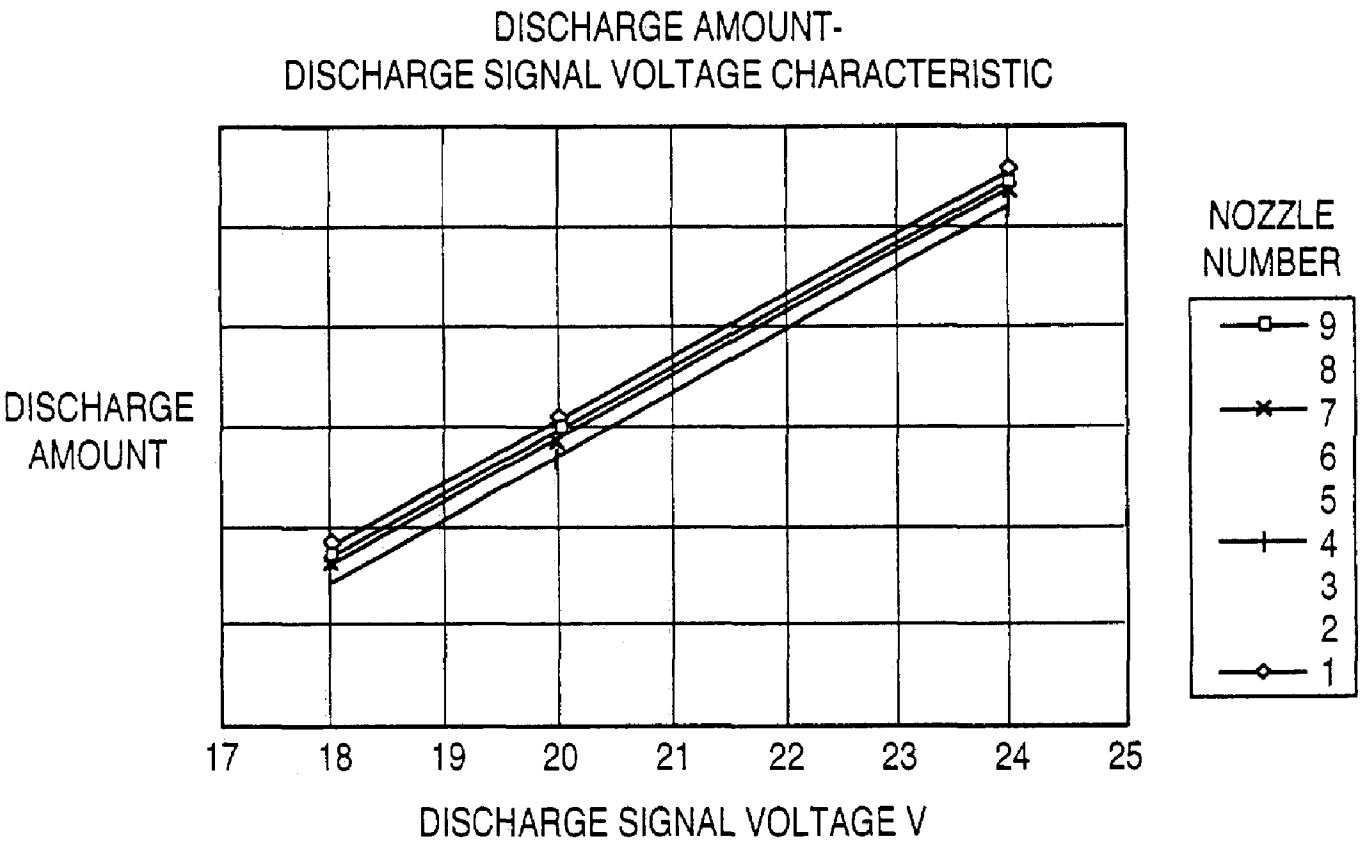
FIG. 26 is a graph showing the relationship between the discharge amount and the driving signal voltage.

FIG. 26 shows the calculation result obtained in step S332 in FIG. 25, and more specifically, the relationship between the driving voltage and the discharge amount with respect to a plurality of nozzles. As shown in FIG. 26, the discharge amount increases with an increase in driving voltage.

Figure 27:
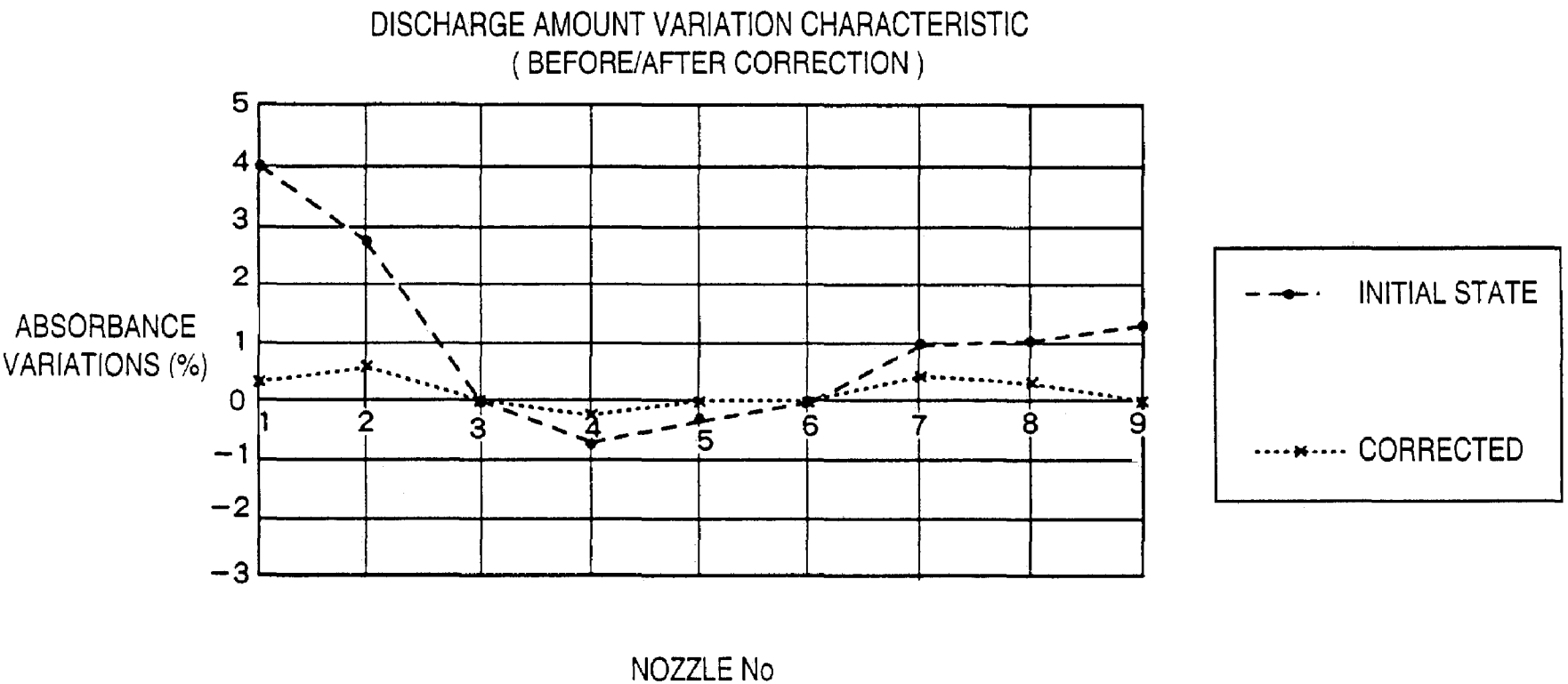
FIG. 27 is a graph showing states before and after execution of discharge amount correction among nozzles.

FIG. 27 shows the relationship between absorbance variations among the pixels printed by the respective nozzles in the initial state and absorbance variations after discharge amount correction made by the above discharge amount correcting device. The discharge amount variation data in the initial state shown in FIG. 27 is data representing the absorbance variations with respect to the discharge amounts when driving voltages are all set to 19 V. The variations reach +4%. In contrast, the absorbance variations after the discharge amounts are corrected by the above discharge amount correcting device are suppressed within ±1%. This indicates that discharge amount correction will reduce variations in the amounts of ink discharged to the respective pixels and hence density unevenness.

When the head and ink in this embodiment are used, the discharge amount can be changed by 1% by setting the set resolution of a signal setting voltage to about 100 mV. In addition, by decreasing the set resolution, discharge amount control can be done within ±0.5%.

Figure 28:
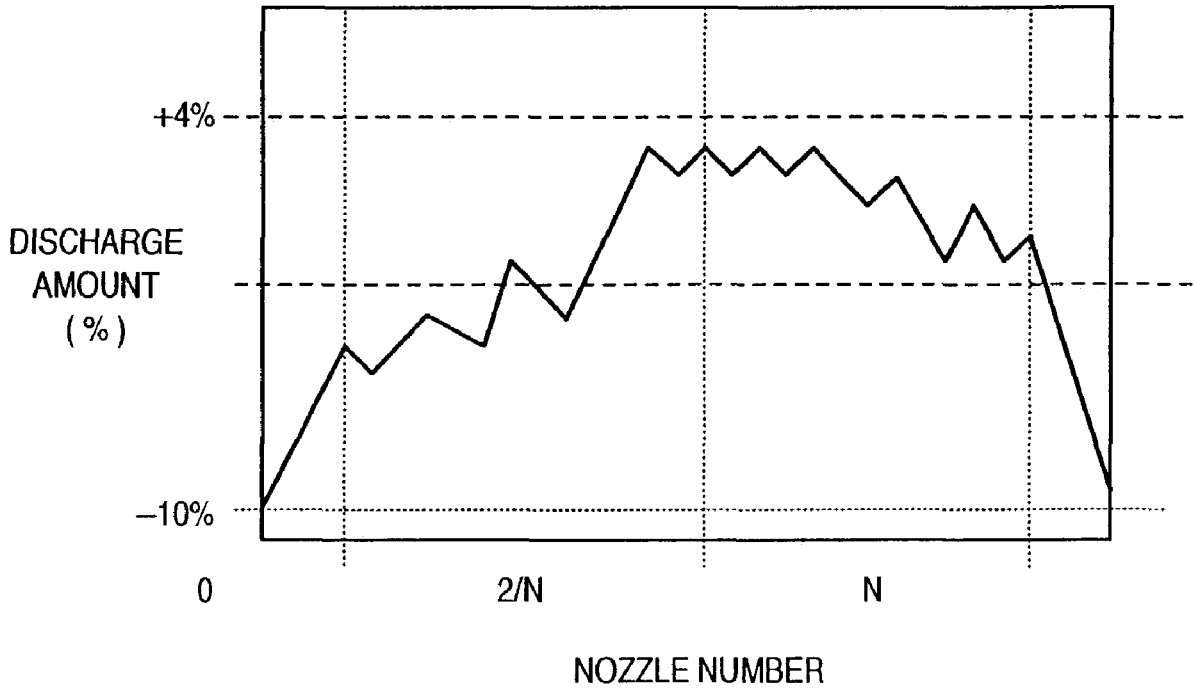
FIG. 28 is a graph showing the discharge amounts without correction in color filter printing operation.
Figure 29:
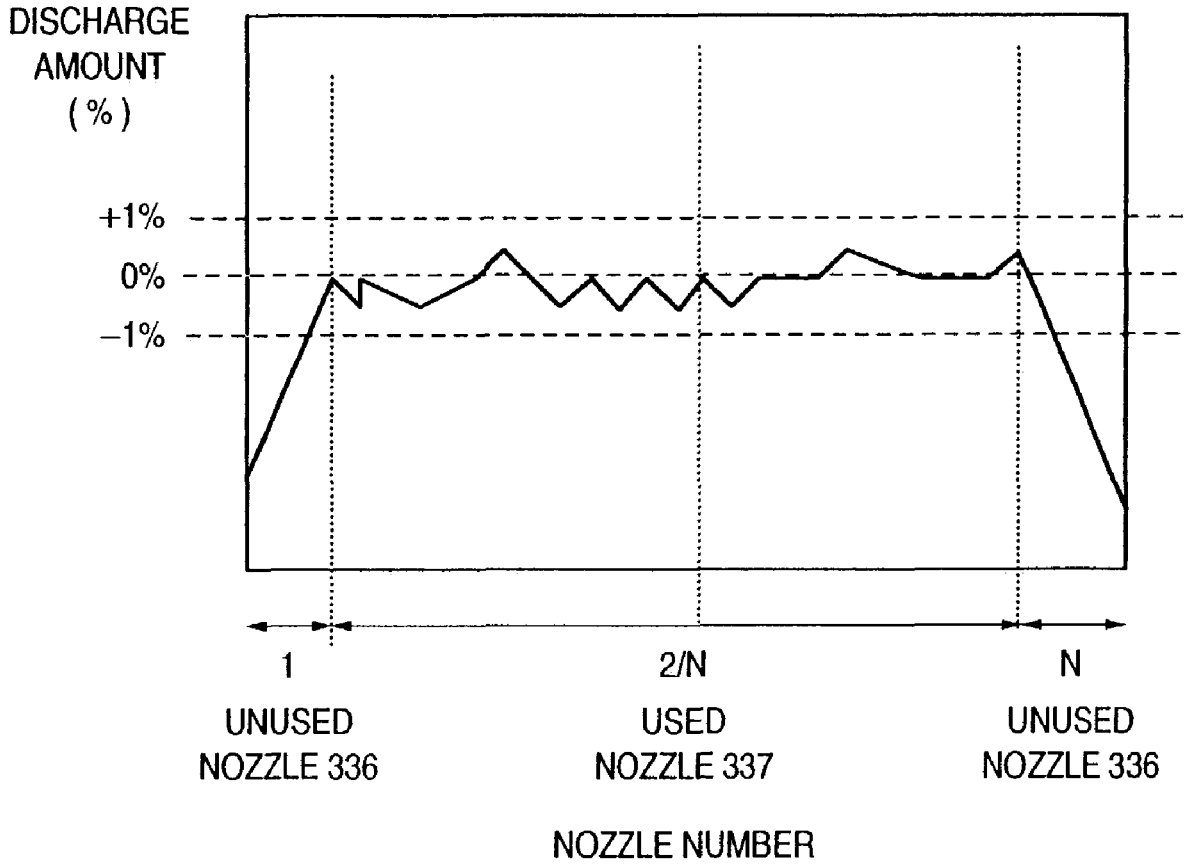
FIG. 29 is a graph showing the discharge amounts upon correction made to a nozzle in use in color filter printing operation.

FIGS. 28 and 29 show how the discharge amount is corrected in actual printing operation for a color filter. FIG. 28 shows discharge amount variations without correction. FIG. 28 shows an example of the discharge amount distribution obtained by an arbitrary head. As shown in FIG. 28, discharge variations among nozzles are large before correction.

FIG. 29 shows discharge amount variations after discharge amount correction is performed for nozzles to be used on the basis of the above discharge amount correction. As shown in FIG. 29, discharge amount variations after correction among the nozzles to be used in printing operation can be suppressed within ±1%. A high-quality color filter with little density unevenness can be manufactured by performing printing operation under this condition.

Figure 8:
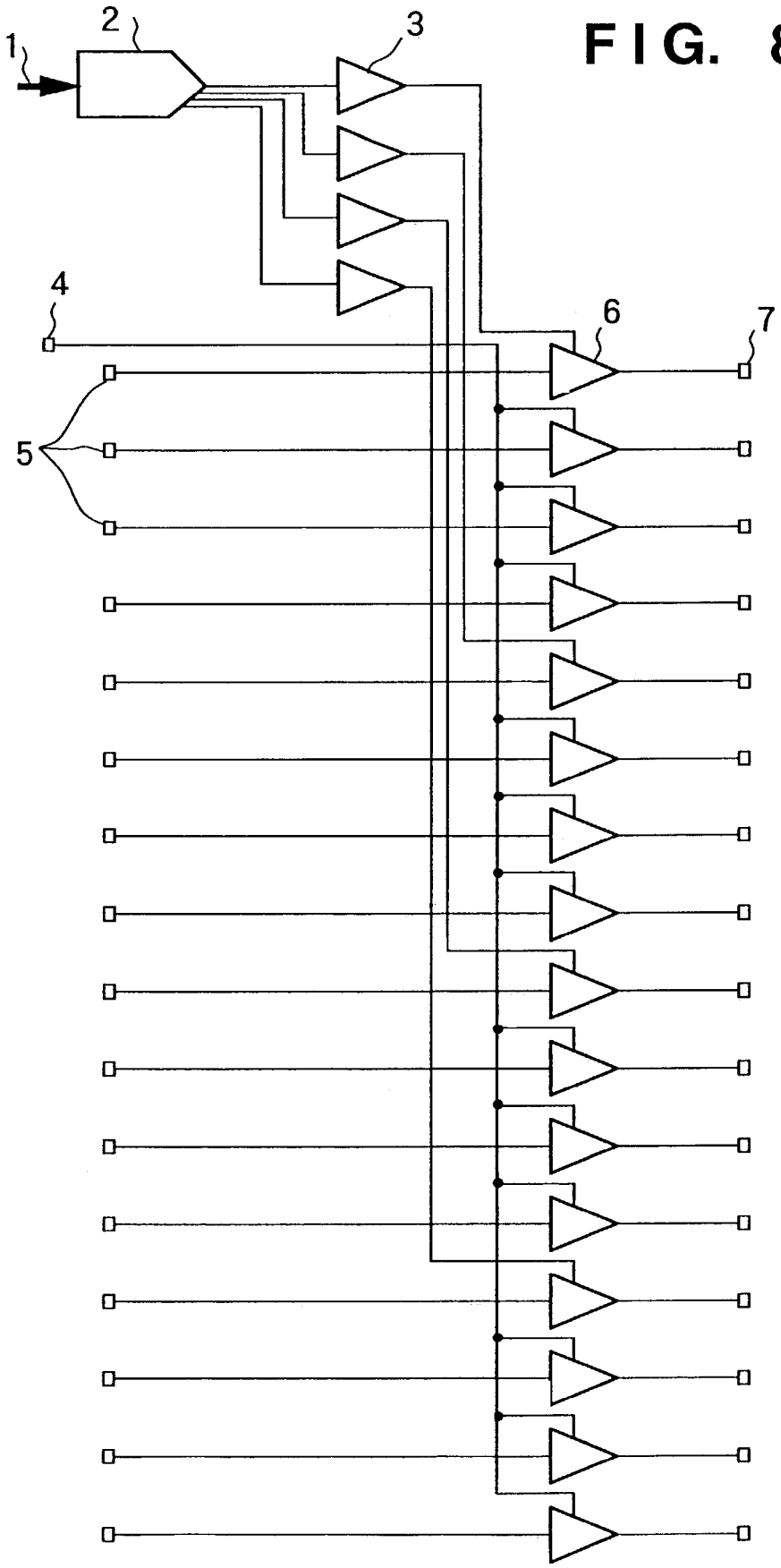
FIG. 8 is a circuit diagram showing the internal circuit arrangement of the head nozzle driving circuit of a printing apparatus according to an embodiment.

FIG. 8 is a view showing the internal circuit arrangement of the head nozzle driving circuit 304 in FIG. 22. FIG. 8 is a view best representing the characteristics of this embodiment.

Referring to FIG. 8, a DA converter 2 receives a command signal 1 for a set control voltage value from a print control unit (print control unit 311 in FIG. 22), and sets a print control voltage for each nozzle changeably. One DA converter 2 incorporates DA converter circuits for four channels. Outputs from the DA converter 2 are amplified by amplifying circuits 3. Each voltage is amplified by a predetermined magnification. A voltage corresponding to the command signal 1 for a set control voltage value is output with high precision. In order to improve the output voltage precision of the amplifying circuit 3, variable resistors or function trimming resistors (not shown) for gain adjustment and offset adjustment are provided for the amplifying circuits 3. A function trimming resistor acquires a desired resistance value by arbitrarily cutting a resistive member with a laser.

Outputs from the amplifying circuits 3 are DC stable voltages. The outputs from the amplifying circuits 3 are input to the power input units of every four driver circuits 6. A common DC stable voltage is applied from a common power input terminal 4 to the three remaining driver circuits of the four driver circuits.

A driving signal at TTL level is input to a channel driving signal input 5. In synchronism with this signal, the driver circuit 6 outputs a driving signal to a channel output terminal 7 in accordance with the voltage level of the power input unit.

When the head nozzle driving circuit shown in FIG. 8 is used, four nozzles are formed into one group, and one discharge amount individual control nozzle and three discharge amount non-control nozzles are provided per group. That is, when a plurality of nozzles are formed into one group, this nozzle group includes a discharge amount individual control nozzle (discharge amount changeable nozzle) which is connected to a voltage control circuit (the DA converter 2 serving as a voltage changing device and amplifying circuit 3) and can change the discharge amount and discharge amount non-control nozzles (discharge amount unchangeable nozzles) which are not connected to any voltage control circuit and cannot change the discharge amounts.

As described above, in this embodiment, discharge amount control circuits (e.g., the above voltage changing devices) capable of controlling the discharge amounts are arranged in correspondence with nozzles smaller in number than all the nozzles instead of being arranged in correspondence with all the nozzles. That is, if the total number of nozzles is N, discharge amount control circuits are arranged in correspondence with only M (M<N) nozzles. Preferably, all the nozzles are formed into a plurality of groups, each constituted by K (K<N) nozzles, and a discharge amount control circuit is provided in correspondence with only one nozzle of each group with no discharge amount control circuits being provided in correspondence with the (K−1) remaining nozzles. Note that the (K−1) nozzles for which no discharge amount control circuits are provided are nozzles that cannot change the discharge amounts. According to this embodiment, since discharge amount control circuits are provided for only some nozzles instead of all the nozzles, discharge amount control can be done without causing any increases in circuit size and cost.

Figure 10:
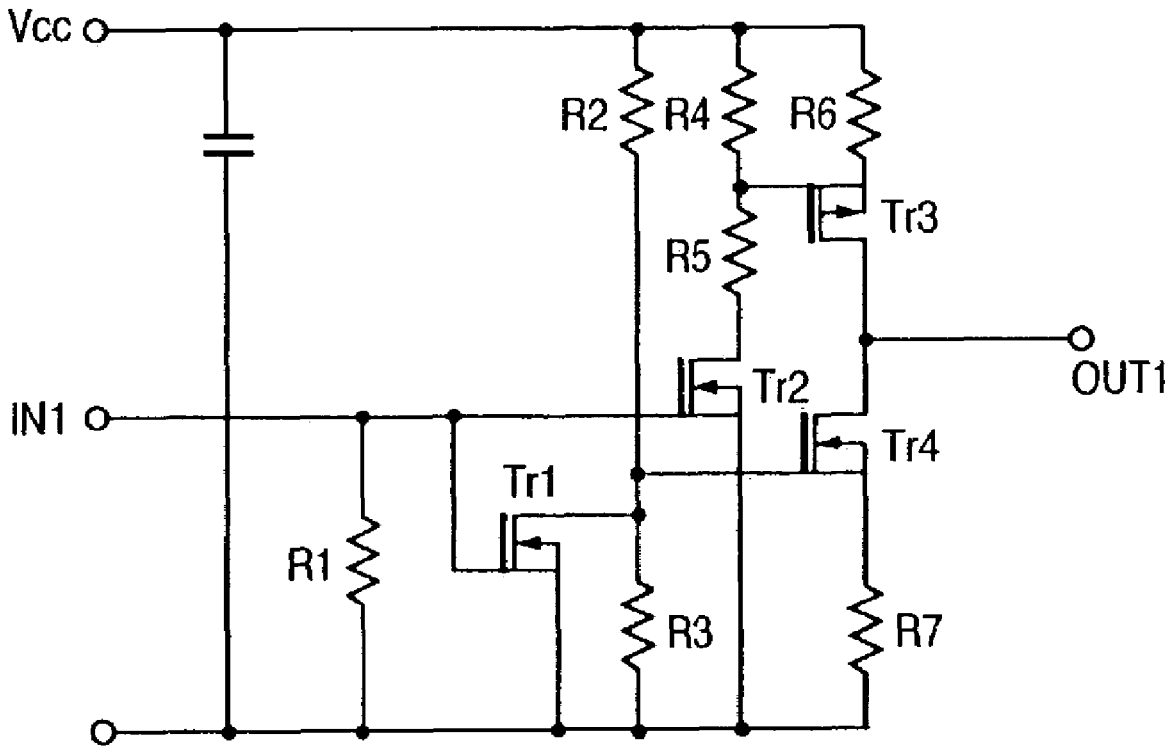
FIG. 10 is a circuit diagram of a driver circuit of the printing apparatus according to the embodiment.

FIG. 10 is a circuit diagram of the driver circuit 6 in FIG. 8. Referring to FIG. 10, reference symbol Tr denotes a transistor or FET; IN1, a driving signal at TTL level; and Vcc, a DC stable voltage set to an arbitrary voltage value.

Referring to FIG. 10, when IN1 is set at high level, Tr1 and Tr2 are turned on, and Tr3 and Tr4 are turned on and off, respectively. As a consequence, a current is discharged from OUT1, and OUT1 is set to a desired voltage.

Referring to FIG. 10, when IN1 is set at low level, Tr1 and Tr2 are turned off, and Tr3 and Tr4 are turned off and on, respectively. As a consequence, a current is sunk by OUT1, and OUT1 is set at ground level or low-voltage level.

Figure 9:
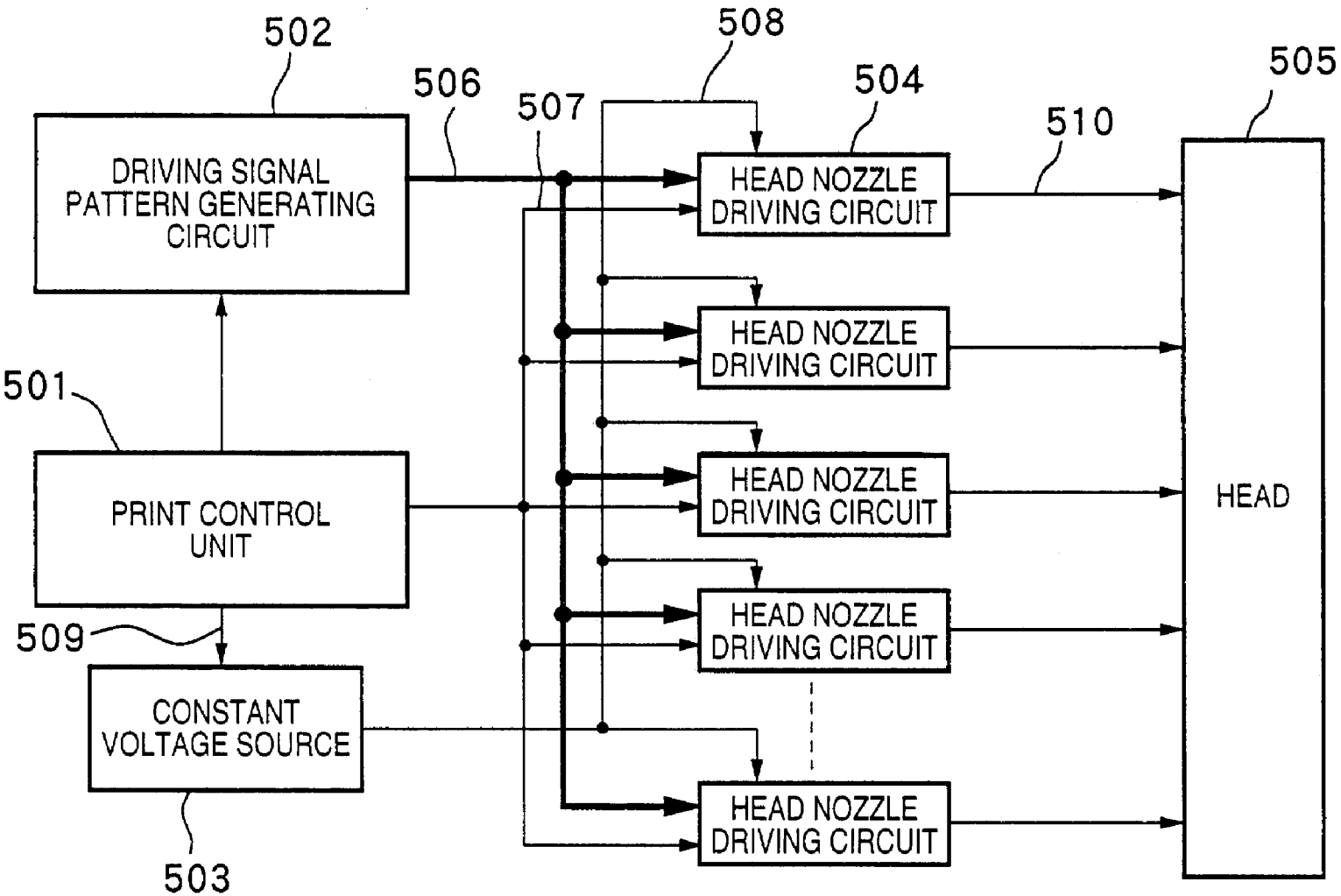
FIG. 9 is a block diagram showing the printing discharge amount control system of the printing apparatus using the head nozzle driving circuit in FIG. 8.

FIG. 9 is a block diagram of a discharge amount control system using the head nozzle driving circuit in FIG. 8. A head nozzle driving circuit 504 in FIG. 9 corresponds to the circuit in FIG. 8.

A print control unit 501 supplies a serial data signal 507 to the head nozzle driving circuit 504. The serial data signal 507 contains set control voltage value information of each nozzle, and corresponds to the command signal 1 in FIG. 8. The print control unit 501 also sends, to the driving signal pattern generating circuit 502, a signal for instructing it to generate a driving signal pattern. In accordance with this instruction, the driving signal pattern generating circuit 502 outputs driving signal patterns 506 for the respective nozzles. These signal patterns are supplied to all the channels of the respective head nozzle driving circuits 504. This operation corresponds to the portion associated with the channel driving signal inputs color filter 610 in FIG. 8. The print control unit 501 sends constant voltage value data 509 to a constant voltage source 503. In accordance with this instruction, the constant voltage source 503 applies a DC voltage 508 to all the head nozzle driving circuits 504.

Upon reception of the above signals, the head nozzle driving circuits 504 output driving signals 510 to a head 505.

Figure 11:
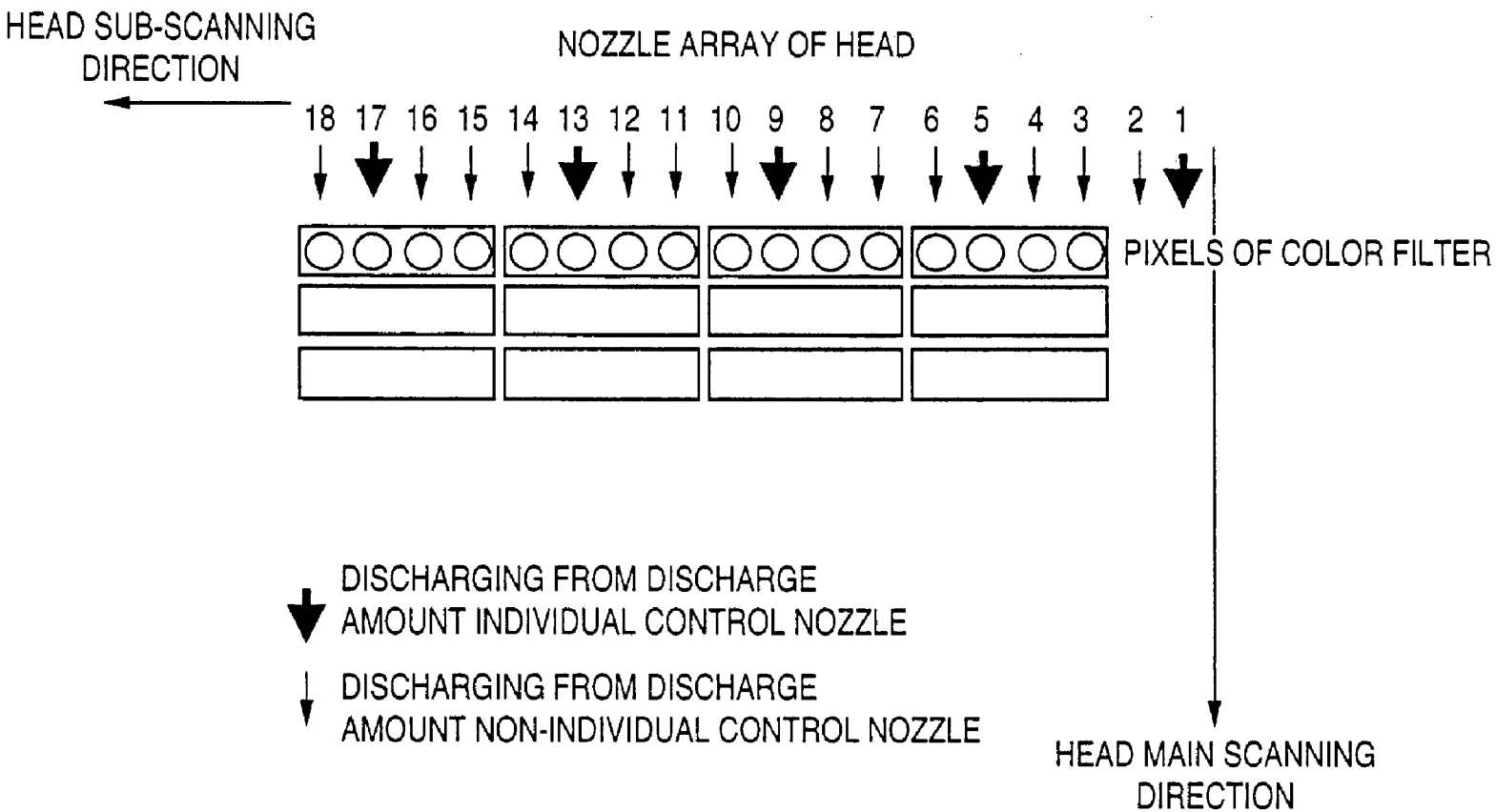
FIG. 11 is a view for explaining how printing is performed by the printing apparatus according to the embodiment.

FIG. 11 is a view showing printing operation, which best represents the characteristics of the printing apparatus according to this embodiment. A plurality of nozzles are arrayed on a head along a predetermined direction (sub-scanning direction). That is, nozzle arrays are arranged parallel to the sub-scanning direction. A color filter is printed by discharging ink onto pixels on a substrate while performing main scanning operation of the head relative to the substrate in a direction (main scanning direction) perpendicular to the sub-scanning direction. Note that the nozzles represented by nozzle Nos. 1, 5, 9, 13, and 17 are discharge amount individual control nozzles (discharge amount changeable nozzles) connected to voltage control devices, and the remaining nozzles are discharge amount non-control nozzles (discharge amount unchangeable nozzles) which are not connected to any voltage control device.

Referring to FIG. 11, one pixel of a color filter is colored by simultaneously discharging ink from four nozzles to the pixel. For example, ink dots are simultaneously printed in the upper rightmost pixel using four nozzles of nozzle Nos. 3, 4, 5, and 6. The four circles (○) in the pixel indicate the landing positions of the respective ink droplets. After landing, however, the four ink droplets almost uniformly spread in the pixel area to uniformly color the pixel.

The reason why four ink droplets uniformly spread in a pixel is that a hydrophilic treatment has been applied to the glass substrate forming the pixel surface to make ink easily flow within the pixel, while a water-repellent treatment has been applied to the black matrix (BM) portion surrounding the pixel to make the BM portion repel ink.

As described above, even if ink is discharged at different positions in one pixel, the ink uniformly spreads in the pixel. Therefore, four nozzles (nozzles 3, 4, 5, and 6) may be regarded as one nozzle group, and the sum of the amounts of ink discharged from the four nozzles may be adjusted to a desired amount (a predetermined amount of ink to be applied to one pixel). More specifically, a correction may be made to eliminate the difference between the sum of the amounts of ink discharged from the four nozzles and the desired amount. This discharge amount correction is made using one nozzle (nozzle 5) of the above four nozzles (nozzles 3, 4, 5, and 6) which serves as a discharge amount individual control nozzle (discharge amount changeable nozzle).

As shown in FIG. 11, the amount of ink discharged from each of four nozzle groups, i.e., nozzle group A (nozzles 3, 4, 5, and 6), nozzle group B (nozzles 7, 8, 9, and 10), nozzle group C (nozzles 11, 12, 13, and 14), and nozzle group D (nozzles 15, 16, 17, and 18), to a corresponding one of pixels may be set to a predetermined value by setting the discharge amount of each of the discharge amount individual control nozzles (nozzles 5, 9, 13, and 17) in the respective nozzle groups to a proper value.

Figure 14:
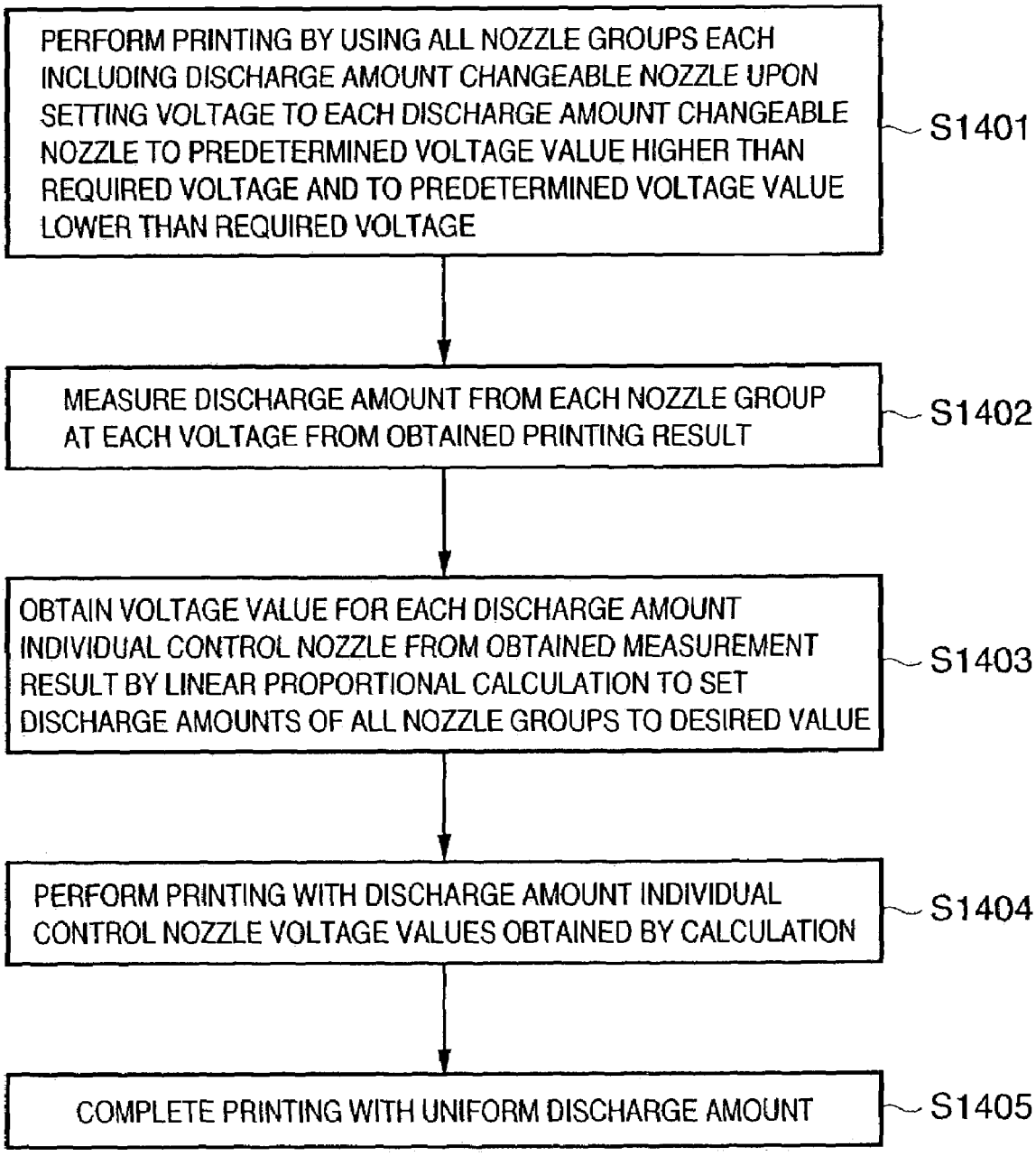
FIG. 14 is a flow chart showing a color filter printing method using a printing apparatus according to an embodiment.

In the above arrangement, the discharge amount uniformization printing sequence in FIG. 25 can be rewritten into the one shown in FIG. 14. Referring to FIG. 25, the discharge amounts of all the nozzles can be independently changed. In contrast, referring to FIG. 14, after the total discharge amount of each nozzle group is measured, the set voltage value for the discharge amount changeable nozzle in each nozzle group is set to a proper value, thereby making the total discharge amounts of all the nozzle groups uniform. Therefore, the amounts of ink applied to the respective pixels of a color filter are made uniform, and a color filter without any density unevenness can be manufactured.

The operation shown in FIG. 11 is based on the assumption that the nozzle interval of the head is smaller than the size of a pixel, the amount of ink required for each pixel can be discharged by one main scanning operation (one pass), and at least one discharge amount individual control nozzle corresponds to one pixel.

Figure 12:
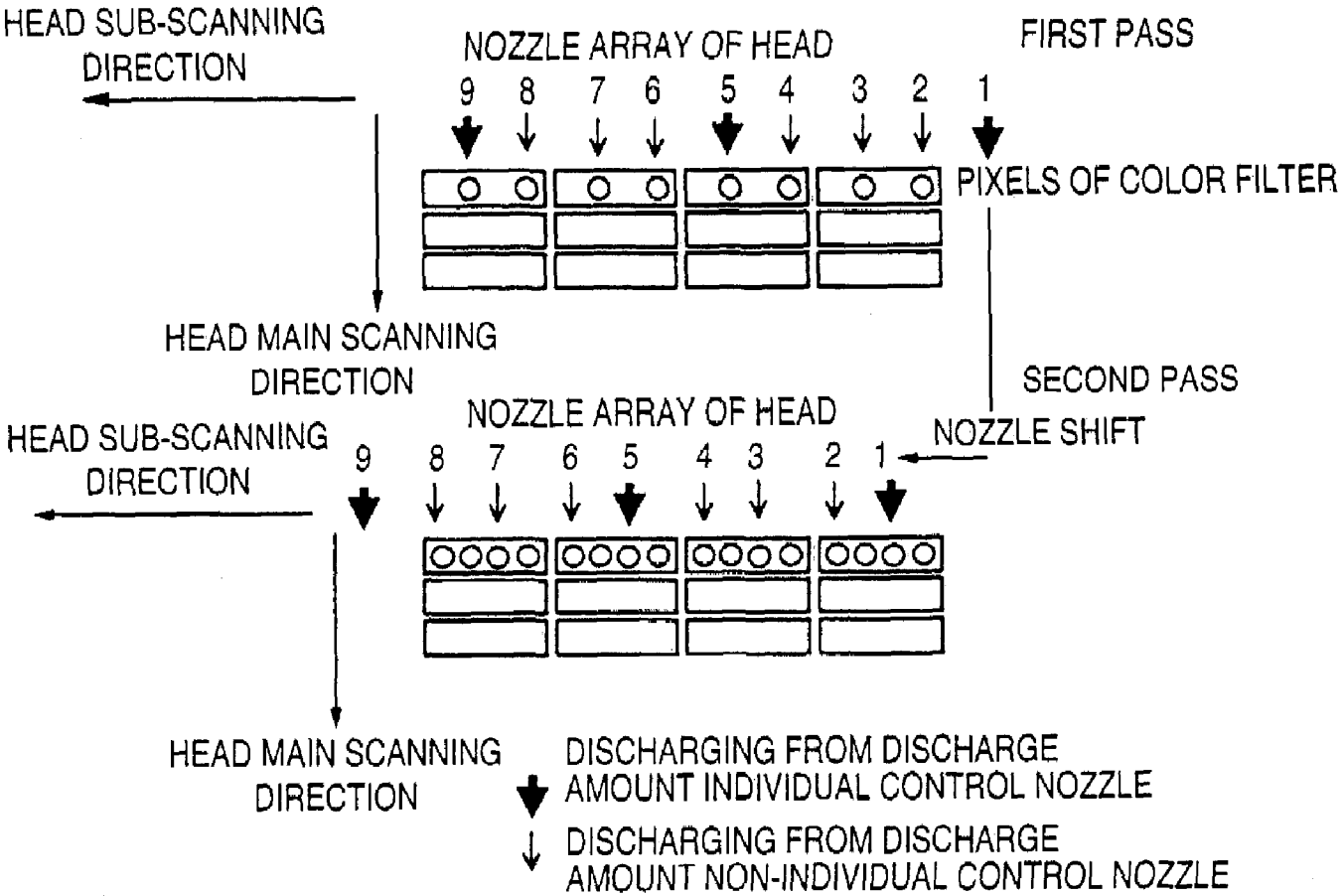
FIG. 12 is a view for explaining how printing is performed by a printing apparatus according to another embodiment.

FIG. 12 is a view for explaining a case wherein ink is discharged to each pixel by two main scanning operations (two passes) because the nozzle interval relative to the pixel size is larger than that in the case shown in FIG. 11, and the amount of ink required for each pixel cannot be discharged by one main scanning operation. Referring to FIG. 12, although the interval between adjacent discharge amount individual control nozzles is larger than the pixel interval, one discharge amount individual control nozzle corresponds to two pixels when the nozzle is shifted in the sub-scanning direction between main scanning operations, as shown in FIG. 12. This makes it possible to discharge ink to the respective pixels using the discharge amount individual control nozzles. Therefore, the amounts of ink discharged to all the pixels can be corrected to become uniform.

More specifically, referring to FIG. 12, ink dots are printed in the upper rightmost pixel in the first pass using nozzles 2 and 3. The head is then shifted in the sub-scanning direction by the distance indicated by the "nozzle shift" arrow, and printing in the second pass is performed. In the second pass, ink dots are printed in the upper rightmost pixel using nozzles 1 and 2. That is, when the printing operations in two passes are totalized, with respect to the upper rightmost pixel, a total of four printing operations are performed, i.e., two operations by nozzle 2, one operation by nozzle 1, and one operation by nozzle 3. The ink landed on the pixel in this total of four printing operations almost uniformly spreads on the pixel area. The fourth printing operations include one printing operation by a discharge amount individual control nozzle (nozzle 1).

Printing on each of the remaining pixels is completed by a total of four ink discharging operations. One discharging operation by a discharge amount individual control nozzle is always included in every four discharging operations. Discharge amount adjustment is performed by one ink discharging operation by this discharge amount individual control nozzle.

Figure 13:
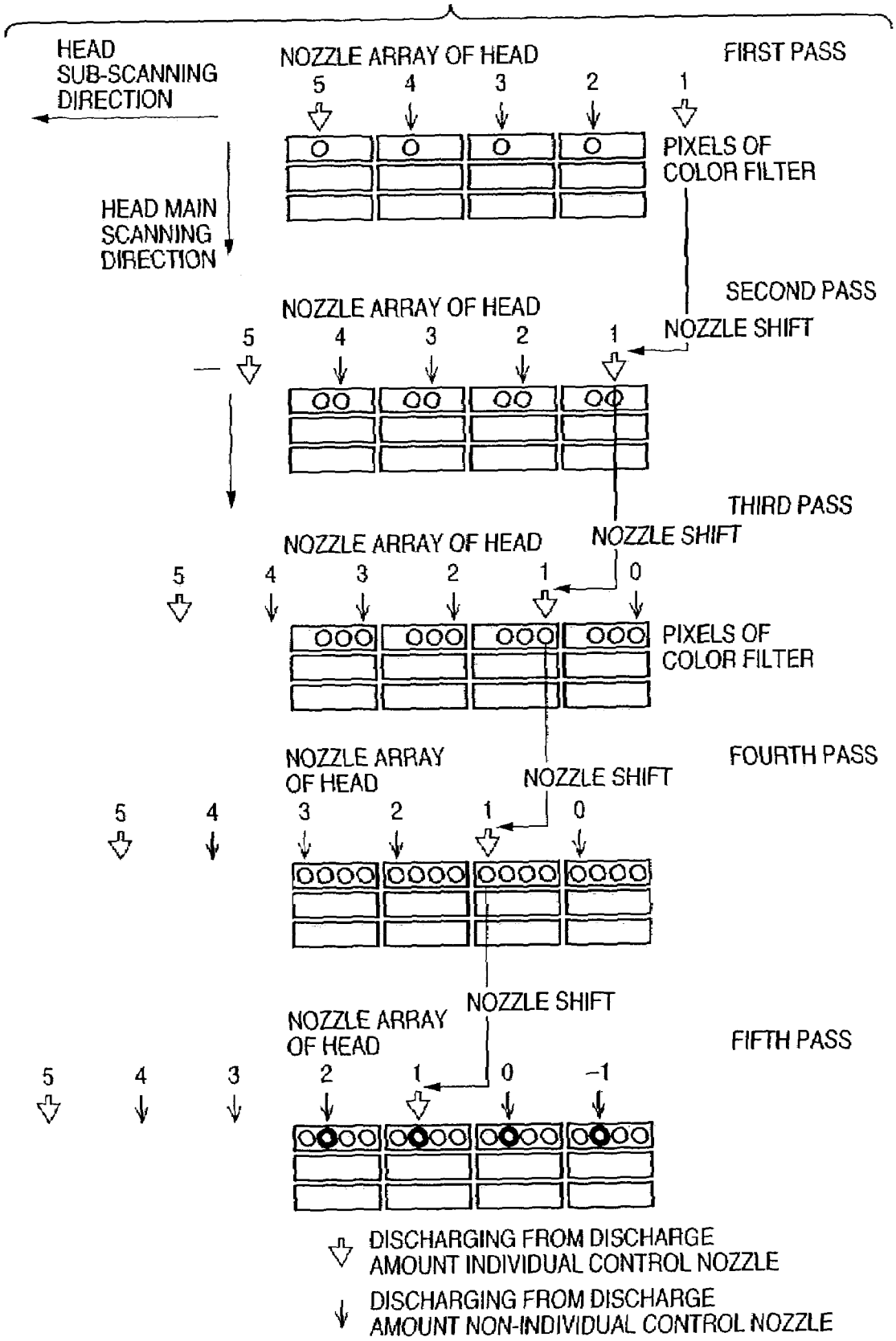
FIG. 13 is a view for explaining how printing is performed by a printing apparatus according to still another embodiment.

FIG. 13 is a view for explaining another form of printing. The nozzle pitch relative to the size of a pixel in FIG. 13 is larger than those in FIGS. 11 and 12. Referring to FIG. 13, printing on each pixel is performed in a total of five passes by making a nozzle shift four times in the sub-scanning direction. For example, printing on the upper rightmost pixel is performed by a total of five ink discharging operations, i.e., one operation by nozzle−1, one operation by nozzle 1, one operation by nozzle 2, and two operations by nozzle 0. The total of five ink discharging operations include one printing operation by a discharge amount individual control nozzle (nozzle 1).

Likewise, printing on each of the remaining pixels is performed by a total of five ink discharging operations. The total of five discharging operations always includes one discharging operation by a discharge amount individual control nozzle. By making the discharge amount individual control nozzle perform one ink discharging operation, the amount of ink applied to each pixel can be controlled to be constant.

The reason why the amount of ink discharged to each pixel can be made uniform by causing each discharge amount individual control nozzle to perform only one of five ink discharging operations for one pixel will be described below. In general, variations in the discharge amounts of nozzles are about ±10% at most. Assume therefore that variations in the discharge amounts of all nozzles are within ±10%. Assume also that the voltage set value for each discharge amount individual control nozzle is 20 V, and the proper amount of ink applied to one pixel (target discharge amount) is 1. In printing on one pixel in a total of five passes, the ideal discharge amount in one pass is 0.2. That is, an average ink amount of 0.2 can be discharged by discharging operation at 20 V.

If the amounts of ink discharged from discharge amount non-control nozzles in four discharging operations under the above condition are all ±10%, the total discharge amount in four discharging operations is $0.2\times1.1\times4=0.88$. In order to obtain the target discharge amount of 1, the amount of ink discharged from the discharge amount individual control nozzle may be set to $1-0.88=0.12$. If the voltage value is proportional to the discharge amount, since $20\ V\times0.12/0.2=12\ V$, the voltage set value for the discharge amount individual control nozzle may be set to 12 V.

If the amounts of ink discharged from discharge amount non-control nozzles in four discharging operations are all −10%, the total discharge amount in four discharging operations is $0.2\times0.9\times4=0.72$. In order to obtain the target discharge amount of 1, the amount of ink discharged from the discharge amount individual control nozzle may be set to $1-0.72=0.28$. If the voltage value is proportional to the discharge amount, since $20\ V\times0.28/0.2=28\ V$, the voltage set value for the discharge amount individual control nozzle may be set to 28 V.

As described above, under the above condition, if the range of voltage set values for each discharge amount individual control nozzle is 12 V to 28 V, the amounts of ink discharged can be made uniform by making the discharge amount individual control nozzle perform only one of five ink discharging operations for one pixel. If the voltage value is not proportional to the discharge amount, the range of voltage set values for each discharge amount individual control nozzle may be ensured in consideration of a corresponding correction amount.

In the above embodiment, the discharge amount of each discharge amount individual control nozzle is changed by changing the set voltage of a signal. However, the discharge amount may be adjusted by changing the pulse width of a signal while keeping the signal voltage constant. In this embodiment, a driving pulse control device capable of changeably setting the pulse width of a driving signal is provided in correspondence with each nozzle group. According to this embodiment, therefore, one nozzle group includes a discharge amount individual control nozzle (discharge amount changeable nozzle) which is connected to a driving pulse control device and can change its discharge amount and discharge amount non-control nozzles (discharge amount unchangeable nozzles) which are not connected to any driving pulse control device and cannot change their discharge amounts.

Discharge amount control can also be performed under a variable condition based on an arbitrary combination of the driving voltage and pulse width of a driving signal.

Figure 15:
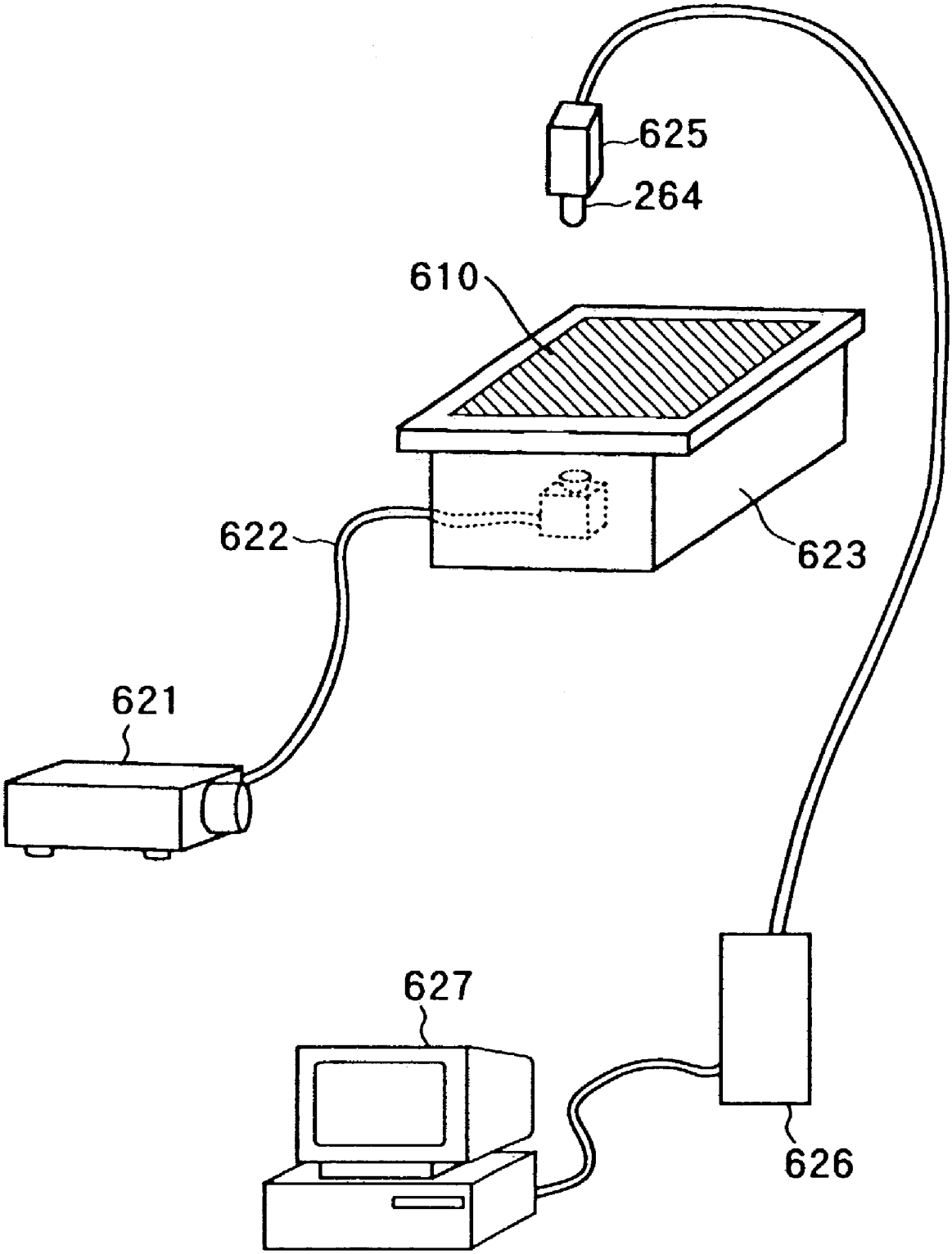
FIG. 15 is a view showing the arrangement of a discharge amount measuring apparatus used in printing operation in an embodiment.
Figure 16:
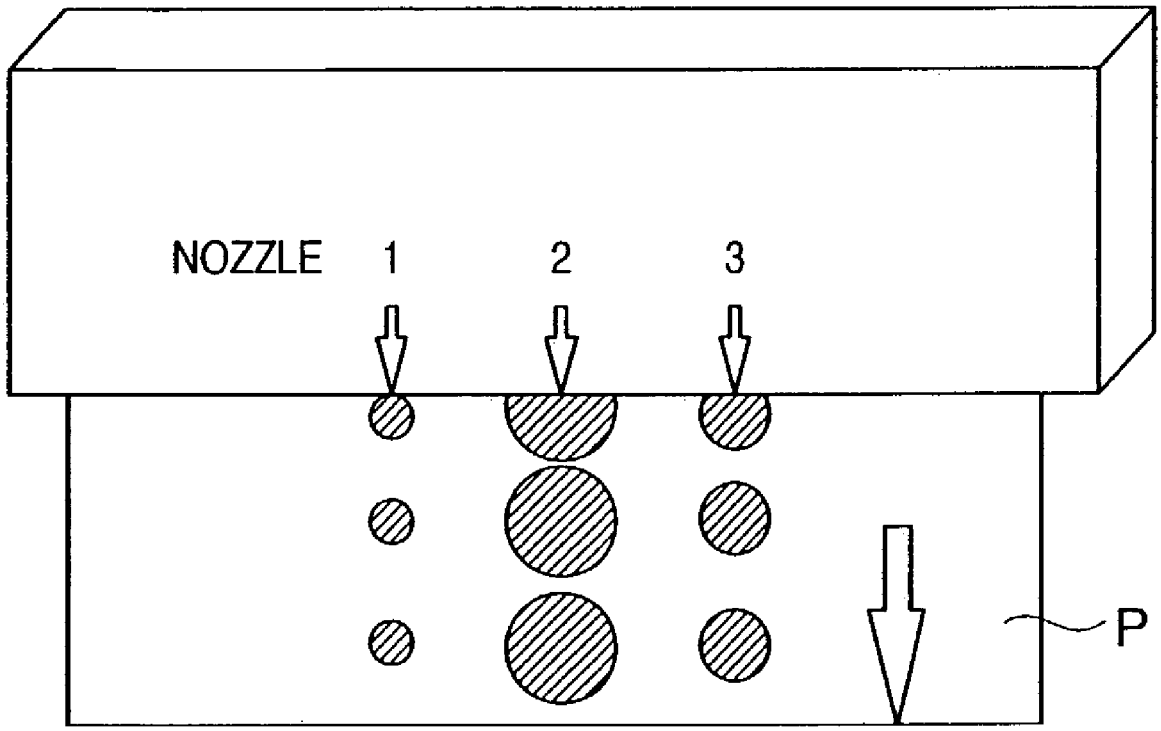
FIG. 16 is a view for explaining a conventional method of reducing density unevenness among the respective pixels of a color filter.
Figure 17:
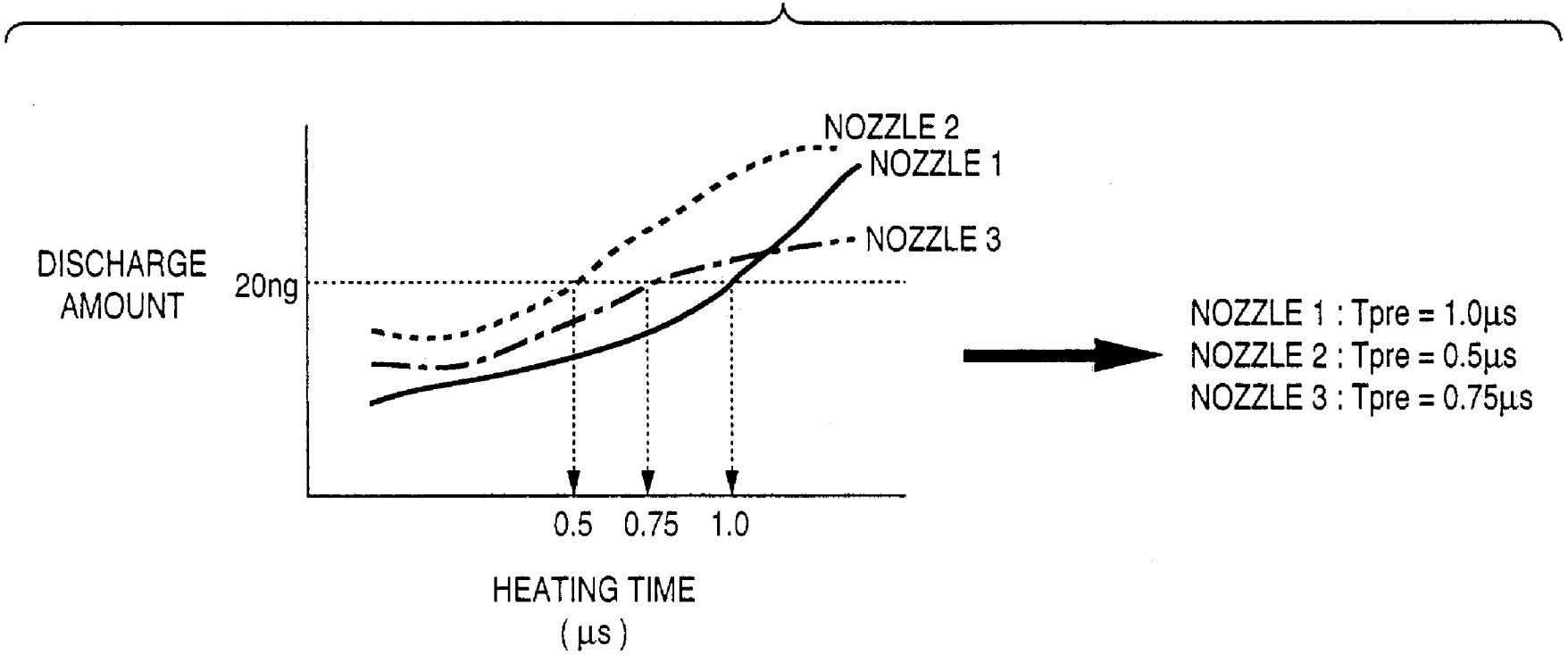
FIG. 17 is a view for explaining the conventional method of reducing density unevenness among the respective pixels of a color filter.
Figure 18:
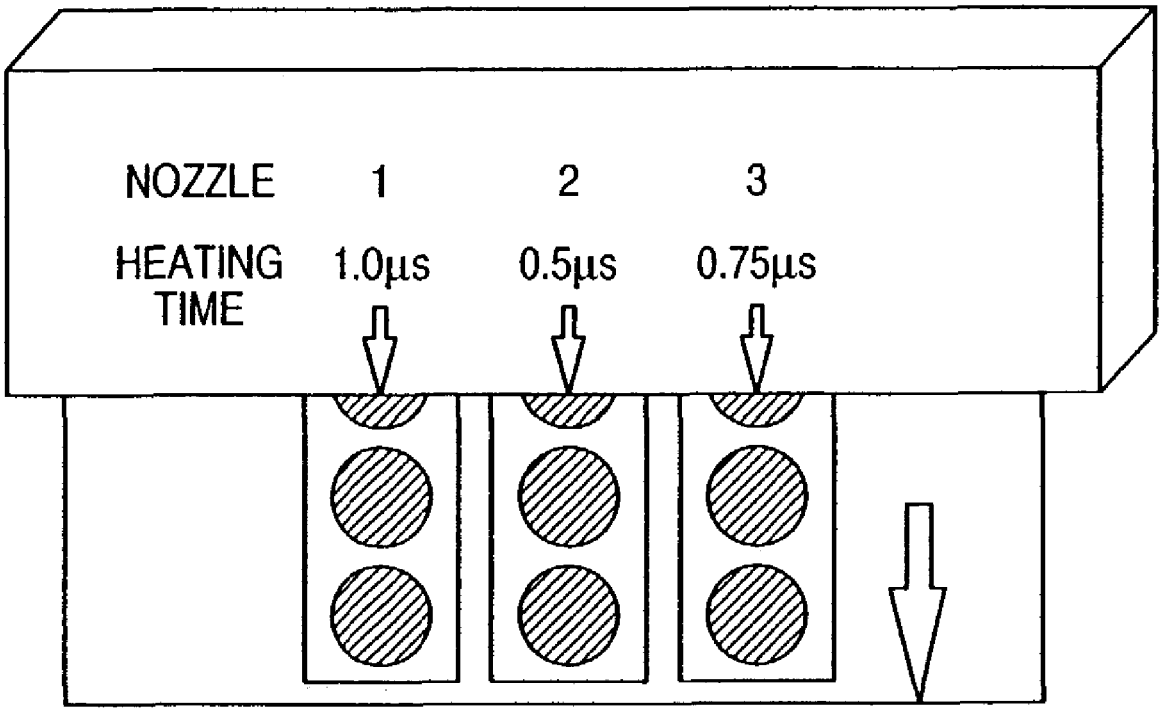
FIG. 18 is a view for explaining the conventional method of reducing density unevenness among the respective pixels of a color filter.
Figure 19:
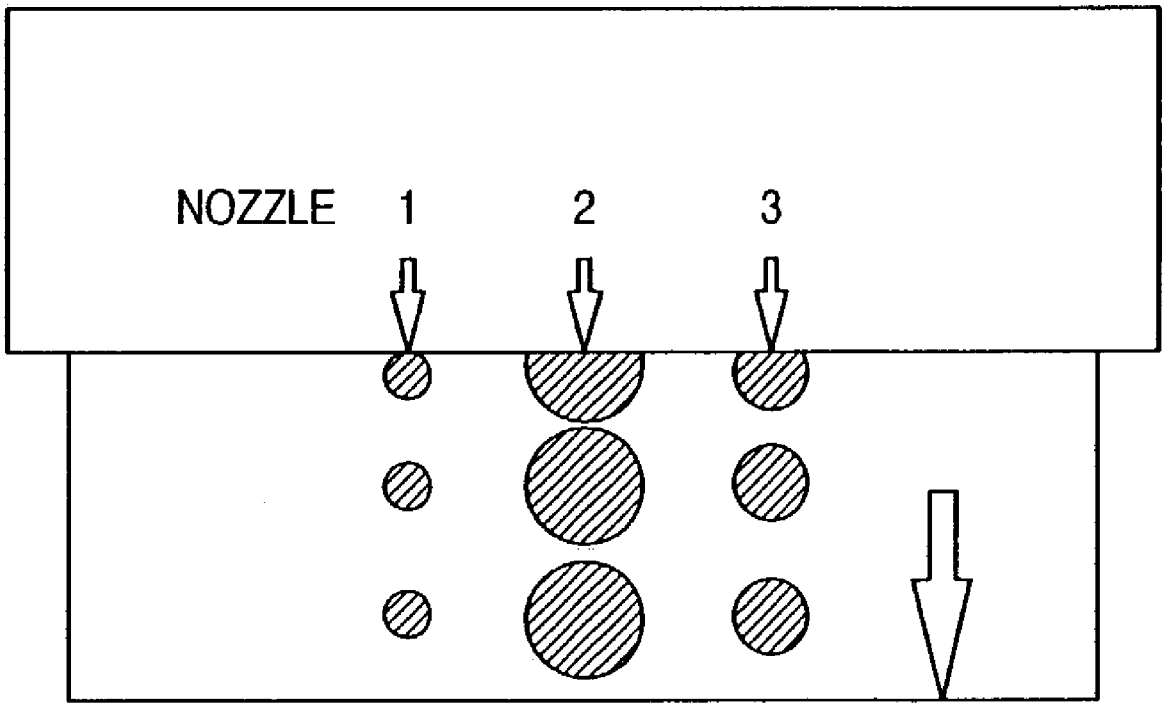
FIG. 19 is a view for explaining another conventional method of reducing density unevenness among the respective pixels of a color filter.
Figure 20:
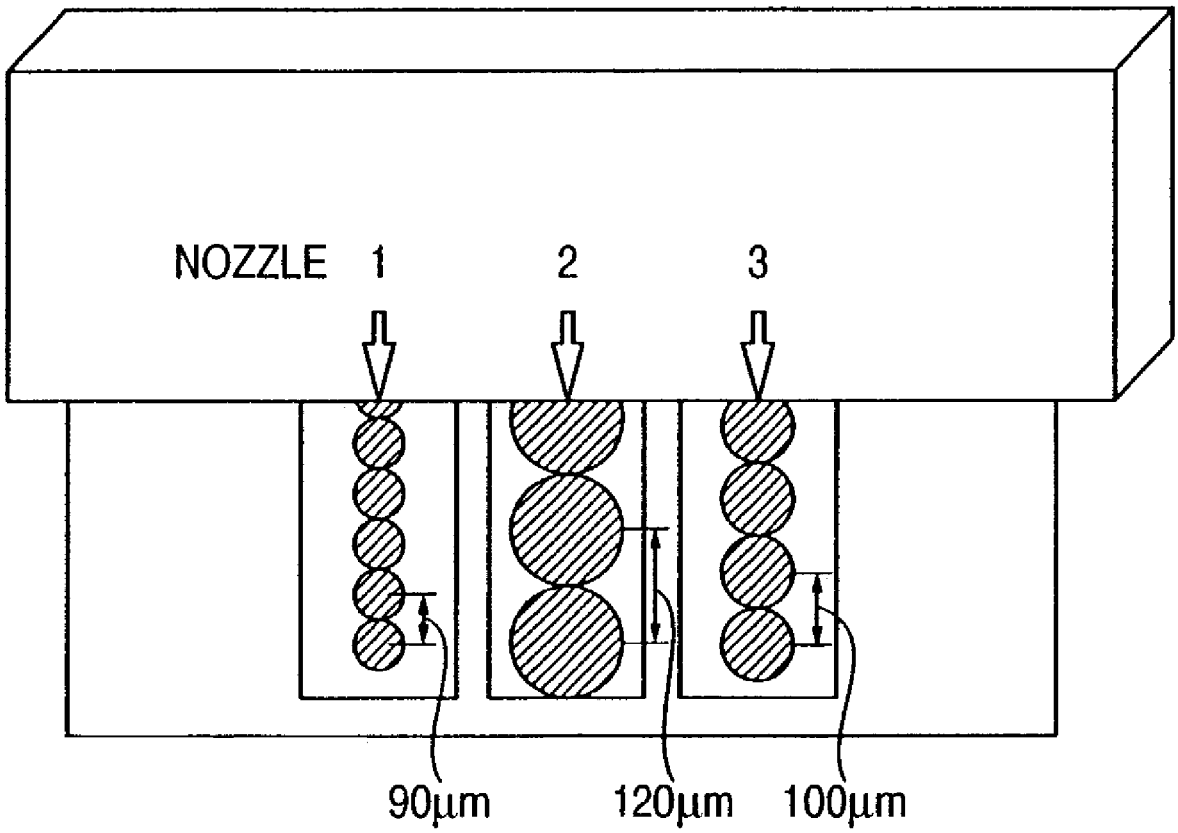
FIG. 20 is a view for explaining the conventional method of reducing density unevenness among the respective pixels of a color filter.

FIG. 15 shows the arrangement of a discharge amount measuring apparatus.

Referring to FIG. 15, reference numeral 610 denotes a color filter; 621, a light source; 622, an optical fiber cable; 623, a substrate stage; 624, an objective lens; 625, a CCD camera; 626, an image processing apparatus; and 627, a control personal computer.

The density of each pixel is measured, using the apparatus shown in FIG. 15, by processing the image captured by the CCD camera 625 while scanning the substrate stage 623. A discharge amount corresponding to the above measured density is obtained by using the relationship between the density and the discharge amount. In consideration of the relationship that the discharge amount increases as the density increases, and the discharge amount decreases as the density decreases, the discharge amount of a nozzle which has printed a pixel with a high density is large, and the discharge amount of a nozzle which has printed a pixel with a low density is small.

The discharge amount for each pixel is measured by the above discharge amount measuring apparatus, and a voltage set value for each discharge amount individual control nozzle is obtained. After the obtained values are set, filter printing operation is performed. The procedure for this operation is the same as that described with reference to FIG. 14.

The present invention is not limited to the above embodiment, and various applications can be made.

For example, colored portions constituting a color filter are not limited to be formed on a glass substrate, and may be formed on pixel electrodes to let the resultant structure function as a color filter. A colored portion is formed on a pixel electrode either by forming an ink-receiving layer on the pixel electrode and applying ink to the ink-receiving layer or by directly applying resin ink containing a coloring material to the pixel electrode.

Note that the present invention can be applied to modifications to the above embodiment and the like without departing from the spirit and scope of the invention.

For example, a panel having a color filter on the TFT array side has recently become available. The color filter defined in this specification is a member colored by coloring materials and includes both a color filter placed on the TFT array side and a color filter placed on the other side.

In addition, the present invention is not limited to the above color filter manufacturing method, and can also be applied to, for example, the manufacture of an EL (electroluminescence) display device. An EL display device has a structure in which a thin film containing inorganic and organic fluorescent compounds is sandwiched between a cathode and an anode. In this device, electrons and holes are injected into the thin film to recombine and generate excitons, and light is emitted by using fluorescence or phosphorescence that occurs when the excitons are deactivated. Of the fluorescent materials used for such EL display devices, materials that emit red, green, and blue light are used in the manufacturing apparatus of the present invention (the manufacturing apparatus including the liquid application apparatus having the liquid discharge head and the liquid discharge amount control mechanism shown in FIGS. 8 to 10) to form a pattern on a device substrate such as a TFT substrate by the ink-jet method, thereby manufacturing a spontaneous emission type full-color EL display device. The present invention incorporates such an EL display device, an EL display device manufacturing method and apparatus, and the like.

The manufacturing apparatus of the present invention may include a device for executing surface treatments such as a plasma process, UV process, and coupling process for a resin resist, pixel electrodes, and the surface of a lower layer to help adhesion of an EL material.

The EL display device manufactured by the manufacturing method of the present invention can be applied to the field of low information, such as segment display and still image display based on full-frame emission, and can also be used as a light source having a point/line/plane shape. In addition, a full-color display device with high luminance and excellent response can be obtained by using passive display devices and active devices such as TFTs.

Figure 21A:
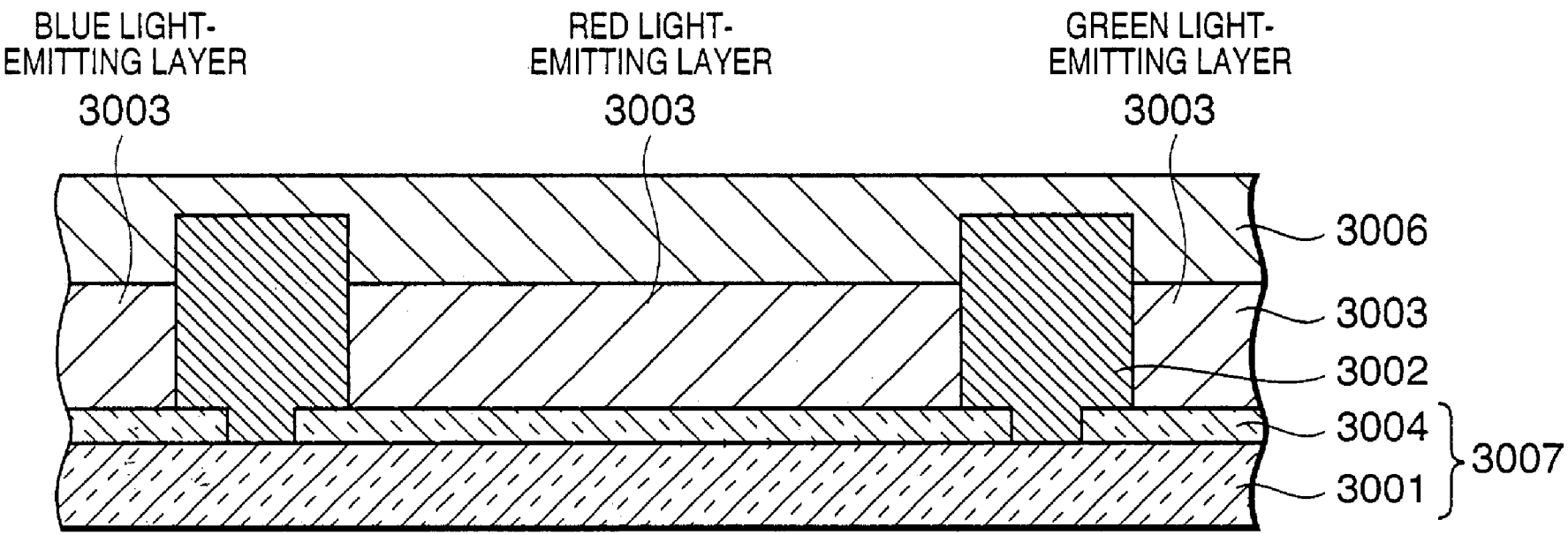
FIG. 21A is a view showing an example of the arrangement of an EL device.

An example of the organic EL device manufactured by the present invention will be described below. FIG. 21A is a sectional view showing the multilayer structure of the organic EL device. The organic EL device shown in FIG. 21A is comprised of a transparent substrate 3001, partition walls (partitioning members) 3002, light-emitting layers (light-emitting portions) 3003, transparent electrodes 3004, and a metal layer 3006. Reference numeral 3007 denotes a portion constituted by the transparent substrate 3001 and transparent electrode 3004. This portion will be referred to as a driving substrate.

The transparent substrate 3001 is not limited to any specific substrate as long as it has the required characteristics of an EL display device, e.g., transparency and mechanical strength. For example, a light-transmitting substrate such as a glass substrate or plastic substrate can be used.

The partition wall (partitioning member) 3002 has the function of isolating pixels from each other to prevent mixing of a material for the luminescent layer 3003 between adjacent pixels when the material is applied from a liquid application head. That is, the partition wall 3002 serves as a color mixing prevention wall. When this partition wall 3002 is formed on the transparent substrate 3001, at least one recess portion (pixel area) is formed on the substrate. Note that no problem arises if a member having a multilayer structure exhibiting affinity different from that of the material is used as the partition wall 3002.

The luminescent layer 3003 is formed by stacking a material that emits light when a current flows therein, e.g., a known organic semiconductor material such as polyphenylene vinylene (PPV), to a thickness enough to obtain a sufficient light amount, e.g., 0.05 μm to 0.2 μm. The luminescent layer 3003 is formed by filling recess portions surrounded by the partition wall 3002 with a thin-film material liquid (spontaneous emission material) by the ink-jet system or the like and heating the resultant structure.

The transparent electrodes 3004 are made of a material having conductivity and transparency, e.g., ITO. The transparent electrodes 3004 are independently formed in the respective pixel areas to emit light on a pixel basis.

The metal layer 3006 is formed by stacking a conductive metal material, e.g., aluminum lithium (Al—Li), to a thickness of about 0.1 μm to 1.0 μm. The metal layer 3006 is formed to serve as a common electrode opposing the transparent electrodes 3004.

The driving substrate 3007 is formed by stacking a plurality of layers, e.g., a thin-film transistor (TFT), wiring film, and insulating film (neither is shown), and designed to allow voltages to be applied between the metal layer 3006 and the transparent electrodes 3004 on a pixel basis. The driving substrate 3007 is manufactured by a known thin-film process.

According to the organic EL device having the above layer structure, in the pixel area between the transparent electrode 3004 and the metal layer 3006 between which a voltage is applied, a current flows in the luminescent layer 3003 to cause electroluminescence. As a consequence, light emerges through the transparent electrode 3004 and transparent substrate 3001.

A process of manufacturing an organic EL device will be described below.

Figure 21B:
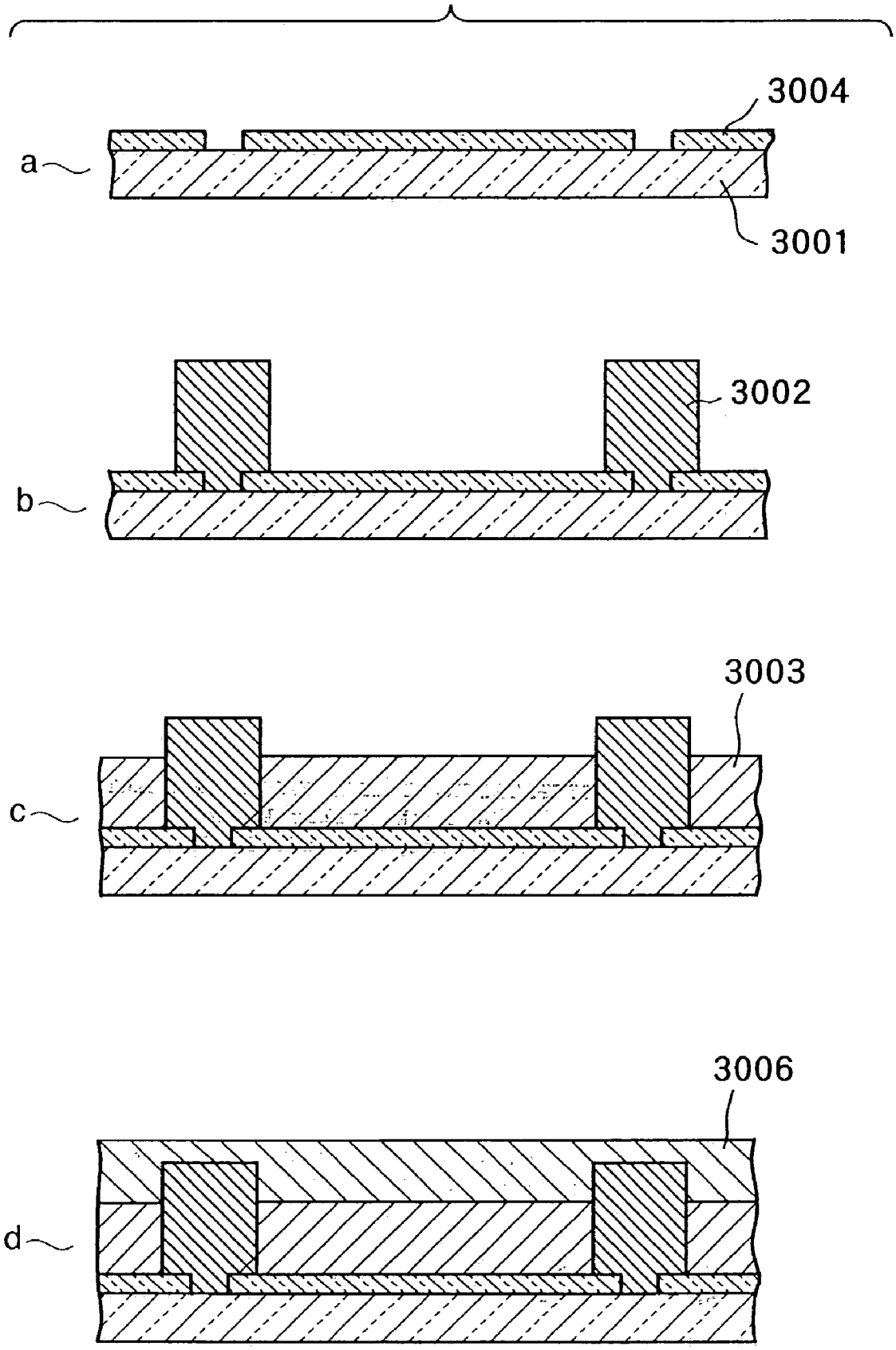
FIG. 21B is a view showing an example of a manufacturing process for an EL device.

FIG. 21B shows an example of the process of manufacturing an organic EL device. Steps (a) to (d) will be described below with reference to FIG. 21B.

Step (a)

First of all, a glass substrate is used as the transparent substrate 3001, and a plurality of layers, e.g., a thin-film transistor (TFT), wiring film, and insulating film (neither is shown), are stacked on each other. The transparent electrodes 3004 are then formed on the resultant structure to allow a voltage to be applied to each pixel area.

Step (b)

The partition walls 3002 are formed between the respective pixels. Each partition wall 3002 serves as a mixing prevention wall for preventing mixing of an EL material solution, which is formed into a luminescent layer, between adjacent pixels when the EL material solution is applied by the ink-jet method. In this case, each partition wall is formed by a photolithography method using a resist containing a black material. However, the present invention is not limited to this, and various materials, colors, forming methods, and the like can be used.

Step (c)

Each recess portion surrounded by the partition walls 3002 is filled with the EL material by the ink-jet system. The resultant structure is then heated to form the luminescent layer 3003.

Step (d)

The metal layer 3006 is further formed on the luminescent layer 3003.

A full-color EL device can be formed by a simple process through steps (a) to (d) described above. In forming a color organic EL device, in particular, an ink-jet system capable of discharging a desired EL material to arbitrary positions can be effectively used because luminescent layers that emit light of different colors, e.g., red, green, and blue, must be formed.

In the present invention, solid portions are formed by filling recess portions surrounded by partition walls with a liquid material. The colored portions of a color filter correspond to the above solid portions, whereas the luminescent portions of an EL device correspond to the solid portions. The solid portions including the above colored portions or luminescent portions are portions (display portions) used to display information and also portions for visual recognition of colors.

The colored portions of a color filter and the luminescent portions of an EL device are portions for producing colors (generating colors), and hence can be called color producing portions. In the case of a color filter, for example, light from a backlight passes through the colored portions to produce R, G, and B light. In the case of an EL device, R, G, and B light is reproduced when the luminescent portions spontaneously emit light.

The above ink and spontaneous emission materials are materials for forming the luminescent portions, and hence can be called color producing materials. In addition, the above ink and spontaneous emission materials are liquids, and hence can be generically called a liquid material. A head having a plurality of nozzles for discharging these liquids is defined as a liquid discharge head or ink-jet head.

The present invention is not limited to the manufacture of the above color filter and EL display device, and can be applied to, for example, the manufacture of an electron-emitting device obtained by forming a conductive thin film on a substrate, and an electron source substrate, electron source, and display panel which use the electron-emitting device.

A method of manufacturing an electron-emitting device and an electron source substrate, electron source, and display panel which use the device will be described as another application of the present invention. Note that the electron-emitting device and the electron source substrate, electron source, and display panel which use the electron-emitting device are used to, for example, perform display operation of a television set.

Figure 30A:
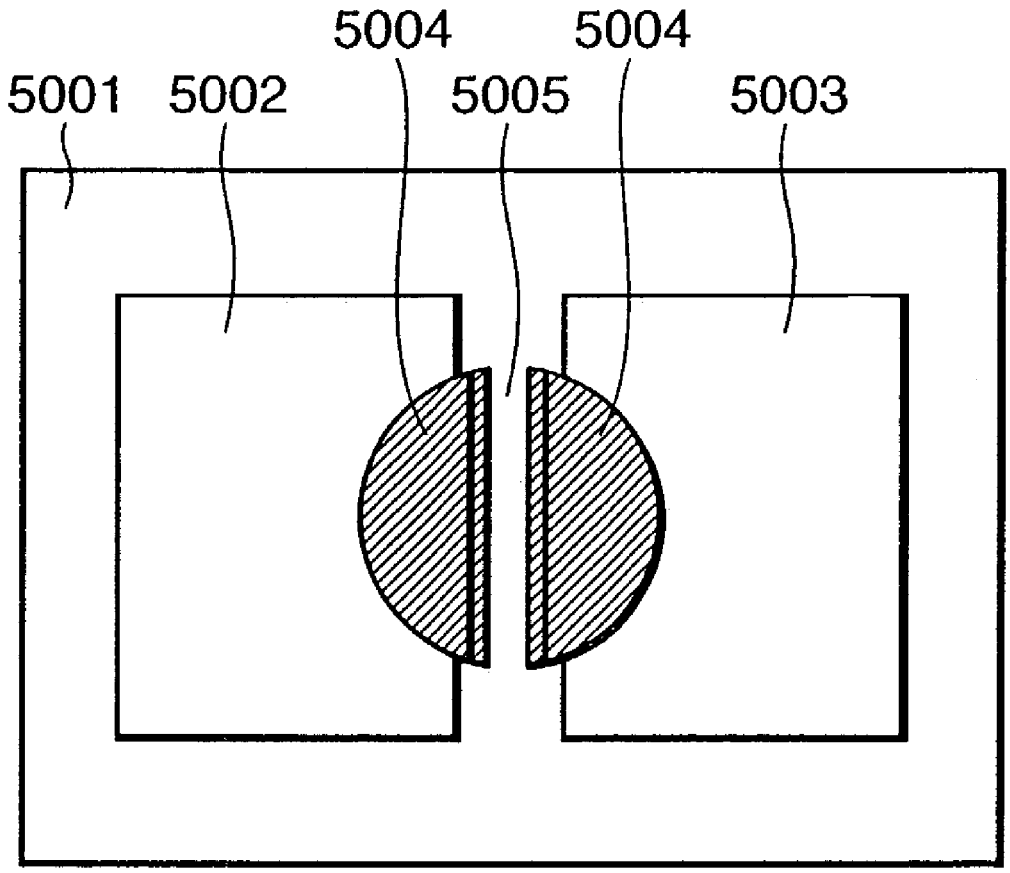
FIGS. 30A and 30B are views showing an example of the arrangement of a surface-conduction emission type electron-emitting device.
Figure 30B:
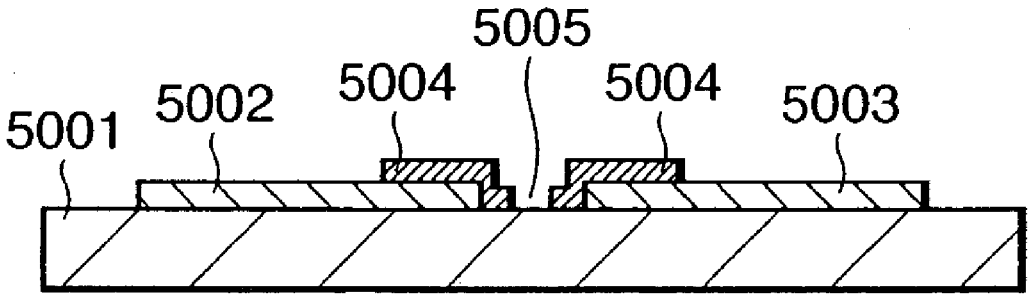

An electron-emitting device (e.g., a surface-conduction emission type electron-emitting device) used for an electron source substrate, electron source, display panel, or the like uses a phenomenon in which when a current flows in a small-area conductive thin film formed on a substrate in a direction parallel to the film surface, electron emission occurs. More specifically, a fissure is formed in advance in a portion of the conductive thin film, and a voltage is applied to the conductive thin film to flow a current therein, thereby emitting electrons from the fissure (to be referred to as the electron-emitting portion). FIGS. 30A and 30B show an example of the structure of such a surface-conduction emission type electron-emitting device.

FIGS. 30A and 30B are schematic views showing an example of the electron-emitting device (surface-conduction emission type electron-emitting device) that can be manufactured by using the manufacturing apparatus of the present invention (the manufacturing apparatus including the liquid application apparatus having the liquid discharge head and the liquid discharge amount control mechanism shown in FIGS. 8 to 10). FIGS. 31A, 31B, 31C, and 31D are views showing an example of the process of manufacturing this surface-conduction emission type electron-emitting device.

Referring to FIGS. 30A, 30B, and 31A to 31D, reference numeral 5001 denotes a substrate; 5002 and 5003, device electrodes; 5004, a conductive thin film; 5005, an electron-emitting portion; 5007, a liquid application apparatus having a liquid discharge head and the liquid discharge amount control mechanism shown in FIGS. 8 to 10; 5024, a droplet of a conductive thin film material liquid discharged from the liquid application apparatus; and 5025, a conductive thin film before electroforming.

Figure 31A:
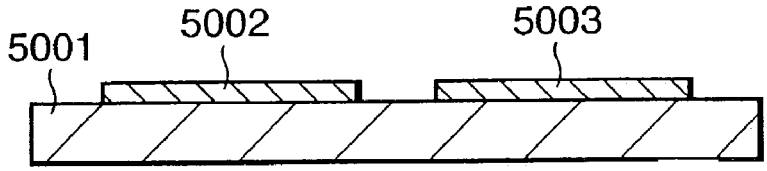
FIGS. 31A to 31D are views showing an example of the process of manufacturing a surface-conduction emission type electron-emitting device.
Figure 31B:
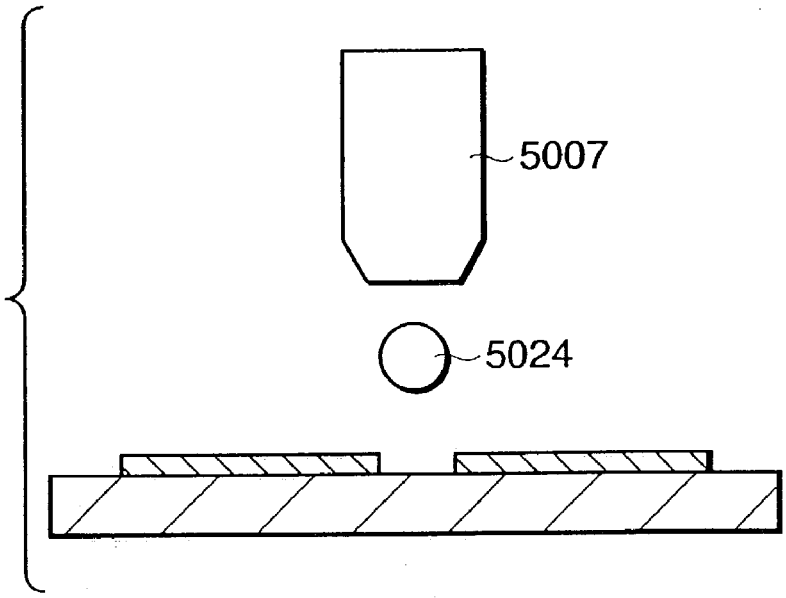
Figure 31C:
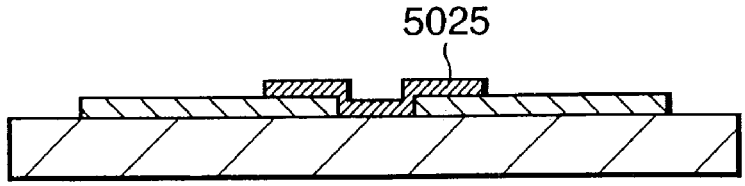
Figure 31D:
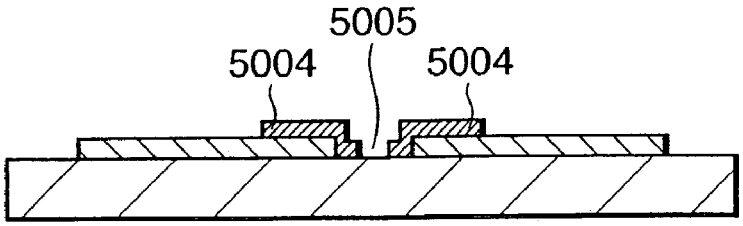

In this case, first of all, the device electrodes 5002 and 5003 are formed on the substrate 5001 at a certain distance L1 (FIG. 31A). The conductive thin film material liquid (more specifically, a liquid containing a metal element) 5024 serving as a liquid material for forming the conductive thin film 5004 is discharged from the liquid discharge head (ink-jet head) 5007 (FIG. 31B) to form the conductive thin film 5004 in contact with the device electrodes 5002 and 5003 (FIG. 31C). A fissure is then formed in the conductive thin film by, for example, a forming process (to be described later), thereby forming the electron-emitting portion 5005.

Since a minute droplet of a liquid containing a metal element can be selectively formed at only a desired position (predetermined area) by using such a liquid application method, no material for an electron-emitting portion is wasted. In addition, there is no need to perform a vacuum process requiring an expensive apparatus or patterning by photolithography including many steps, and hence the production cost can be decreased.

Although any apparatus capable of discharging an arbitrary droplet can be used in practice as the liquid application apparatus 5007, an ink-jet apparatus is preferably used, which can control the amount of liquid within the range of ten odd ng to several ten ng and can easily discharge a droplet of a small amount of about 10 ng to several ten ng. Note that a method of manufacturing a surface-conduction emission type electron-emitting device using an ink-jet liquid application apparatus is disclosed in Japanese Patent Laid-Open No. 11-354015.

As the conductive thin film 5004, a fine-grained film is especially preferable, which is formed of fine particles, in order to obtain good electron emission characteristics. The thickness of this film is properly set in accordance with step coverage for the device electrodes 5002 and 5003, the resistance value between the device electrodes 5002 and 5003, electroforming conditions (to be described later), and the like. This thickness is preferably set to several Å to several thousand Å, and more preferably, 10 Å to 500 Å. The sheet resistance of this film is $10^3$ to $10^7$ Ω/□.

As a material for the conductive thin film 5004, one of the following materials can be used: metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, and HfN, semiconductors such as Si and Ge, and carbon.

The fine-grained film in this case is a film formed from an aggregation of fine particles. This film includes not only a film having a fine structure in which fine particles are separately dispersed but also a film having a fine structure in which adjacent fine particles are located adjacent to each other or overlap (including a structure in which particles exist in the form of islands). The diameter of a fine particle is several Å to several thousand Å, and more preferably, 10 Å to 200 Å.

A liquid from which the droplet 5024 is formed includes a liquid obtained by dissolving the above conductive thin film material in water, a solvent, organometallic solution, or the like.

As the substrate 5001, one of the following is used: a quartz glass substrate, a glass substrate containing a small amount of an impurity such as Na, a soda-lime glass substrate, a glass substrate having $SiO_2$ formed on its surface, and a ceramic substrate made of alumina or the like.

As a material for the device electrodes 5002 and 5003, a general conductor is used; for example, one of the following materials is properly selected: metals such as Ni, Cr, Au, Mo, W, Pt, Ti, Al, Cu, and Pd or their alloys, metals or metal oxides such as Pd, Ag, Au, $RuO_2$, and Pd—Ag, printed conductors made of glass materials and the like, transparent conductors such as $In_2O_3$—$SnO_2$, and semiconductor materials such as polysilicon.

The electron-emitting portion 5005 is a high-resistance fissure formed in a portion of the conductive thin film 5004 by electroforming or the like. The fissure may contain conductive fine particles having diameters of several Å to several hundred Å. These conductive fine particles contain at least some of the elements of the material for the conductive thin film 5004. In addition, the electron-emitting portion 5005 and the nearby conductive thin film 5004 may contain carbon and carbides.

The electron-emitting portion 5005 is formed by applying an energization process called electroforming to the device constituted by the conductive thin film 5004 and device electrodes 5002 and 5003. As disclosed in Japanese Patent Laid-Open No. 2-56822, electroforming is performed by supplying a current from a power supply (not shown) to between the device electrodes 5002 and 5003 so as to locally destroy, deform, or degenerate the conductive thin film 5004, thereby forming a portion whose structure has been changed. This portion obtained by locally changing the structure of the film is called the electron-emitting portion 5005. A voltage waveform for electroforming preferably has a pulse-like shape, in particular. Electroforming is performed either by consecutively applying voltage pulses having a constant peak value or by applying voltage pulses while increasing the peak value.

When voltage pulses are to be applied while the peak value is increased, voltage pulses are applied in a proper vacuum atmosphere while the peak value (the peak voltage in electroforming) is increased in about 0.1-V steps.

In this electroforming process, a device current is measured, and a resistance value is obtained at a voltage not so high as to locally destroy/deform the conductive thin film 5004, e.g., a voltage of about 0.1 V. When, for example, the resistance becomes 1 MΩ or more, the electroforming process is terminated.

A process called an activation process is preferably applied to the device having undergone the electroforming. The activation process is a process of repeatedly applying a voltage pulse with a constant peak value in a vacuum of about $10^{-4}$ to $10^{-5}$ Torr as in electroforming. In this process, carbon and carbides originating from organic substances existing in the vacuum are deposited on the conductive thin film to greatly change a device current If and discharge current Ie. In the activation process, the device current If and discharge current Ie are measured. When, for example, the discharge current Ie is saturated, this process is terminated.

In this case, the carbon and carbides include graphite (both single crystal and polycrystal) amorphous carbon (a mixture of amorphous carbon and polycrystalline graphite). The thickness of this film is preferably 500 Å or less, and more preferably, 300 Å or less.

The electron-emitting device manufactured in this manner is preferably operated in an atmosphere with a higher vacuum than in the electroforming process and activation process. In addition, this device is preferably operated after being heated to 80° C. to 150° C. in a higher vacuum atmosphere.

Note that the vacuum higher than those in the electroforming process and-activation process is, for example, about $10^{-6}$ Torr or more, and more preferably, an ultra-high vacuum, in which carbon and carbides are hardly deposited on the conductive thin film. This makes it possible to stabilize the device current If and discharge current Ie.

A flat surface-conduction emission type electron-emitting device can be manufactured in the above manner.

Figure 32:
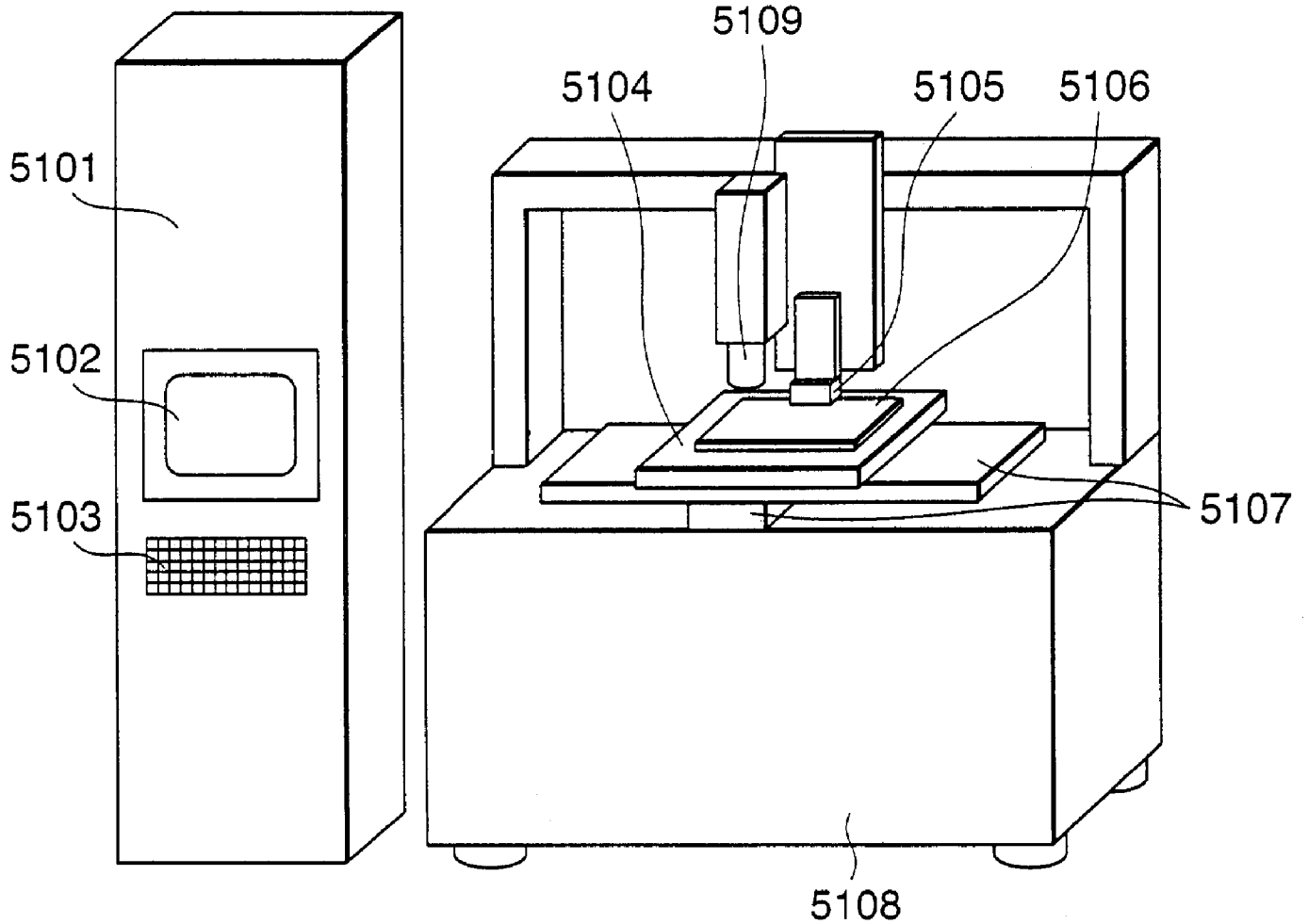
FIG. 32 is a perspective view showing a manufacturing apparatus including a liquid discharge apparatus for manufacturing a surface-conduction emission type electron-emitting device.

FIG. 32 is a perspective view of a manufacturing apparatus including a liquid discharge apparatus for manufacturing a surface-conduction emission type electron-emitting device. Referring to FIG. 32, reference numeral 5101 denotes a housing; 5102, the monitor of a personal computer housed in the housing; 5103, a personal computer keyboard or operation panel; 5104, a stage on which a substrate 5106 is mounted; 5105, a liquid discharge head (ink-jet head) for discharging a liquid to the substrate 5106 on which a surface-conduction emission type electron-emitting device is formed; 5107, an X-Y stage which can freely move in the vertical and horizontal directions to apply a droplet to an arbitrary position on the substrate 5106; 5108, a surface plate which holds the overall liquid discharge apparatus; and 5109, an alignment camera for aligning the discharge position of a droplet on the substrate 5106. The manufacturing apparatus having this arrangement is basically operated in the same manner as the color filter manufacturing apparatus described with reference to FIG. 1. Note that as an alignment method for a substrate, a conductive thin film forming method, and a forming method, the methods disclosed in Japanese Patent Laid-Open No. 11-354015 can be used.

Figure 33:
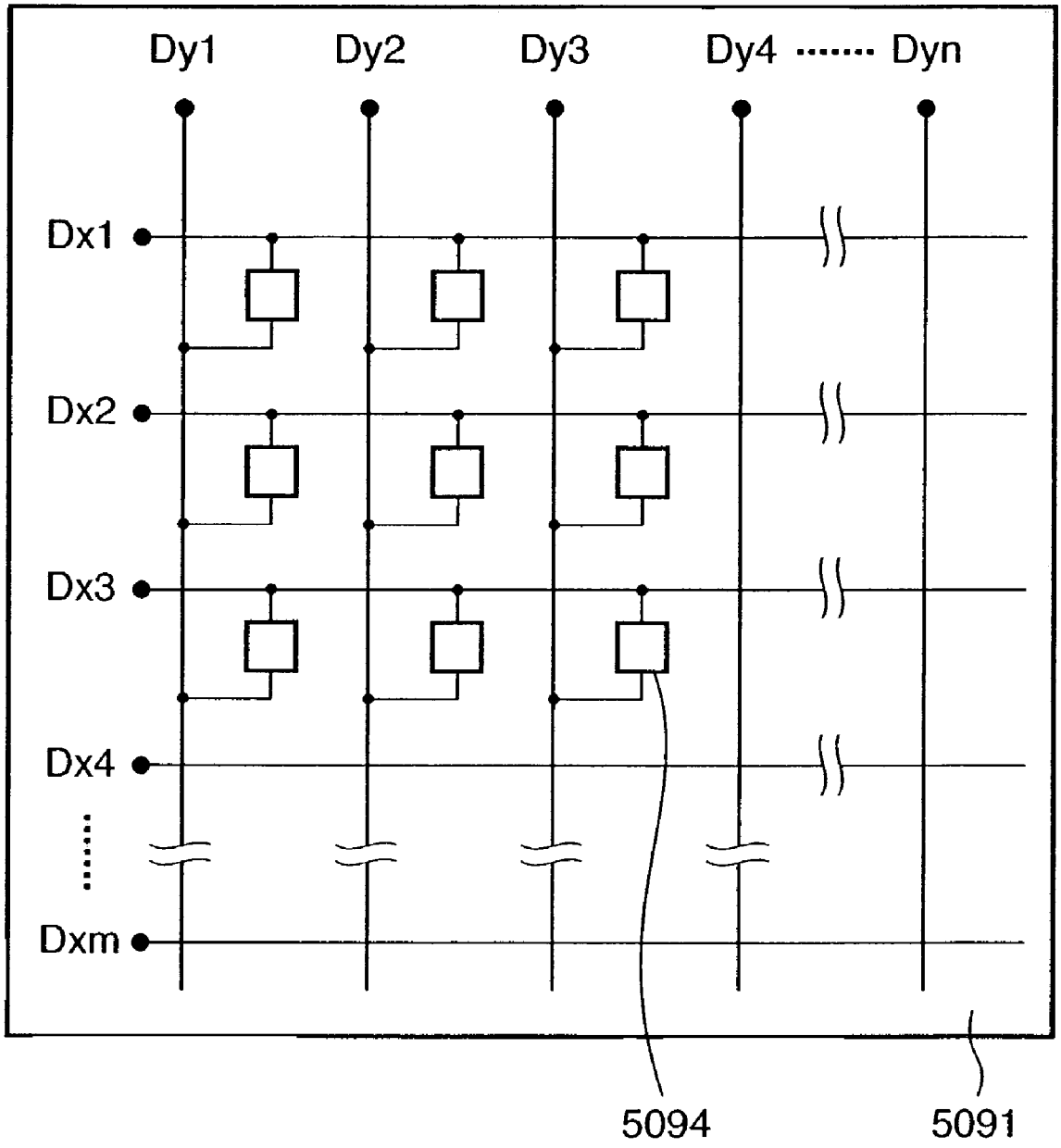
FIG. 33 is a view showing an example of a display panel including a plurality of electron-emitting devices.

A plurality of surface-conduction emission type electron-emitting devices manufactured in the above manner are arrayed on a substrate to form a display panel. FIG. 33 is a view showing a display panel 5091 including a plurality of surface-conduction emission type electron-emitting devices 5094. The plurality of surface-conduction emission type electron-emitting devices on this display panel are arranged, for example, in the form of an m (rows)×n (columns) matrix. Television display can be performed by driving the surface-conduction emission type electron-emitting devices in the display panel on the basis of an image signal (e.g., an NTSC TV signal). Note that the method disclosed in Japanese Patent Laid-Open No. 11-354015 can be used to manufacture a display panel.

By executing the above discharge amount uniformization control operation according to the present invention, the shapes of the conductive thin films of all the electron-emitting devices included in the display panel can be made uniform. If, therefore, the electron-emitting devices of display panel are manufactured by the present invention, conductive thin films forming the electron-emitting devices can be uniformly arranged. This makes it possible to manufacture a display panel with high image quality.

As has been described above, this embodiment is not configured to control the discharge amounts of all the nozzles individually, but is configured to include nozzles capable of individually controlling discharge amounts (discharge amount individual control nozzles) and nozzles which cannot control discharge amounts (discharge amount non-control nozzles). This makes it possible to decrease the circuit size and reduce the control load accompanying discharge amount adjustment as compared with the case wherein all the nozzles are discharge amount individual control nozzles. In addition, the presence of the discharge amount individual control nozzles allows to set the amount of ink applied to each pixel to a desired amount, thereby making the amounts of liquid filled in the respective pixels uniform.

As has been described above, according to the above embodiment, the amounts of liquid discharged from the liquid discharge head (ink-jet head) to predetermined areas can be made uniform while an increase in circuit size is suppressed.

As many apparently widely different embodiments of the present invention can be made without departing from the spirit and scope thereof, it is to be understood that the invention is not limited to the specific embodiments thereof except as defined in the appended claims.

What is claimed is:

1. A liquid discharge apparatus comprising:

a liquid discharge head including at least one first nozzle having a discharge driving element connected to discharge amount control means which is capable of individually controlling a liquid discharge amount of the at least one first nozzle, and at least one second nozzle having a discharge driving element which is never connected to a discharge amount control means that is capable of individually controlling a liquid discharge amount of the at least one second nozzle, the at least one second nozzle discharging the same liquid as liquid discharged from the at least one first nozzle; and control means for controlling said liquid discharge head to discharge the liquid to each of a plurality of pixels on a substrate so that each of the plurality of pixels is formed by a plurality of liquid discharges discharged from a set of nozzles including the at least one first nozzle and at the least one second nozzle.

2. A liquid discharge apparatus which discharges a liquid from a liquid discharge head having a plurality of nozzles for discharging the liquid, wherein said liquid discharge head includes a first nozzle that ejects the liquid and which has a discharge driving element connected to discharge amount control means capable of individually changing a liquid discharge amount of the first nozzle, and a second nozzle that ejects the liquid and which has a discharge driving element which is never connected to a discharge amount control means that is capable of individually controlling a liquid discharge amount of the second nozzle.

3. A liquid discharge apparatus which discharges a liquid from a liquid discharge head having a plurality of nozzles for discharging the liquid, wherein said liquid discharge head includes a first nozzle that ejects the liquid and which has a first discharge driving element connected to a voltage control circuit capable of individually changing a voltage supplied to the first discharge driving element, and a second nozzle that ejects the liquid and which has a second discharge driving element which is never connected to a voltage control circuit that is capable of individually changing a voltage supplied to the second discharging driving element so as to individually control a liquid discharge amount of the second nozzle.

4. A liquid discharge method comprising the steps of:

providing a liquid discharge head including at least one first nozzle having a discharge driving element connected to discharge amount control means which is capable of individually controlling a liquid discharge amount of the at least one first nozzle, and at least one second nozzle having a discharge driving element which is never connected to a discharge amount control means that is capable of individually controlling a liquid discharge amount of the at least one second nozzle, the at least one second nozzle discharging the same liquid as liquid discharged from the at least one first nozzle; and controlling the liquid discharge head to discharge the liquid to each of a plurality of pixels on a substrate so that each of the plurality of pixels is formed by a plurality of liquid discharges discharged from a set of nozzles including the at least one first nozzle and the at least one second nozzle.

5. A liquid discharge method comprising the step of:

discharging a liquid from a liquid discharge head having a plurality of nozzles for discharging the liquid, wherein the liquid discharge head includes a first nozzle that ejects the liquid and which has a discharge driving element connected to discharge amount control means capable of individually changing a liquid discharge amount of the first nozzle, and a second nozzle that ejects the liquid and which has a discharge driving element which is never connected to a discharge amount control means that is capable of individually controlling a liquid discharge amount of the second nozzle, the liquid being discharged from the liquid discharge head to a substrate.

6. The method according to claim 5, wherein the substrate has a pixel area partitioned by a black matrix, the liquid discharge head discharges ink as the liquid from the nozzles, and a color filter is manufactured by discharging the ink from the liquid discharge head to the pixel area on the substrate.

7. The method according to claim 5, wherein the substrate has a pixel area serving as a light-emitting portion, the liquid discharge head discharges an electroluminescence material as the liquid from the nozzles, and an electroluminescence device having the light-emitting portion is manufactured by discharging the electroluminescence material from the liquid discharge head to the pixel area on the substrate.

8. The method according to claim 5, wherein the substrate has an area serving as a conductive thin film portion, the liquid discharge head discharges a conductive thin film material as the liquid from the nozzles, and an electro-emitting device having the conductive thin film portion is manufactured by discharging the conductive thin film material from the liquid discharge head to the area on the substrate.

9. The method according to claim 5, wherein the substrate has areas serving as conductive thin film portions, the liquid discharge head discharges a conductive thin film material as the liquid from the nozzles, and a panel including a plurality of electro-emitting devices having the conductive thin film portions is manufactured by discharging the conductive thin film material from the liquid discharge head to the areas on the substrate.

10. A liquid discharge method comprising the step of:

discharging a liquid from a liquid discharge head having a plurality of nozzles for discharging the liquid, wherein the liquid discharge head includes a first nozzle that ejects the liquid and which has a first discharge driving element connected to a voltage control circuit capable of individually changing a voltage supplied to the first discharge driving element, and a second nozzle that ejects the liquid and which has a second discharge driving element which is never connected to a voltage control circuit that is capable of individually changing a voltage supplied to the second discharging driving element so as to individually control a liquid discharge amount of the second nozzle, the liquid being discharged from the liquid discharge head to a substrate.

11. A panel manufacturing apparatus which manufactures a panel used for a display device by discharging, onto a substrate, a liquid from a liquid discharge head, comprising:

the liquid discharge head including at least one first nozzle having a discharge driving element connected to discharge amount control means which is capable of individually controlling a liquid discharge amount of the at least one first nozzle, and at least one second nozzle having a discharge driving element which is never connected to a discharge amount control means that is capable of individually controlling a liquid discharge amount of the at least one second nozzle, the at least one second nozzle discharging the same liquid as liquid discharged from the at least one first nozzle; and control means for controlling said liquid discharge head to discharge the liquid to each of a plurality of pixels on the substrate so that each of the plurality of pixels is formed by a plurality of liquid discharges discharged from a set of nozzles including the at least one first nozzle and the at least one second nozzle.

12. A panel manufacturing apparatus which manufactures a panel used for a display device by discharging, onto a substrate, a liquid from a liquid discharge head having a plurality of nozzles for discharging the liquid, wherein said liquid discharge head includes a first nozzle that ejects the liquid and which has a discharge driving element connected to discharge amount control means capable of individually changing a liquid discharge amount of the first nozzle, and a second nozzle that ejects the liquid and which has a discharge driving element which is never connected to a discharge amount control means that is capable of individually controlling a liquid discharge amount of the second nozzle.

13. A panel manufacturing apparatus which manufactures a panel used for a display device by discharging, onto a substrate, a liquid from a liquid discharge head having a plurality of nozzles for discharging the liquid, wherein said liquid discharge head includes a first nozzle that ejects the liquid and which has a first discharge driving element connected to a voltage control circuit capable of individually changing a voltage supplied to the first discharge driving element, and a second nozzle that ejects the liquid and which has a second discharge driving element which is never connected to a voltage control circuit that is capable of individually changing a voltage supplied to the second discharging driving element so as to individually control a liquid discharge amount of the second nozzle.

14. A panel manufacturing method which manufactures a panel used for a display device by discharging, onto a substrate, a liquid from a liquid discharge head, comprising the steps of:

providing the liquid discharge head including at least one first nozzle having a discharge driving element connected to discharge amount control means which is capable of individually controlling a liquid discharge amount of the at least one first nozzle, and at least one second nozzle having a discharge driving element which is never connected to a discharge amount control means that is capable of individually controlling a liquid discharge amount of the at least one second nozzle, the at least one second nozzle discharging the same liquid as liquid discharged from the at least one first nozzle; and controlling the liquid discharge head to discharge the liquid to each of a plurality of pixels on the substrate so that each of the plurality of pixels is formed by a plurality of liquid discharges discharged from a set of nozzles including the at least one first nozzle and the at least one second nozzle.

15. A panel manufacturing method which manufactures a panel used for a display device by discharging, onto a substrate, a liquid from a liquid discharge head having a plurality of nozzles for discharging the liquid, wherein a panel is manufactured by discharging, onto the substrate, the liquid from the liquid discharge head including a first nozzle that ejects the liquid and which has a discharge driving element connected to discharge amount control means capable of individually changing a liquid discharge amount of the first nozzle, and a second nozzle that ejects the liquid and which has a discharge driving element which is never connected to a discharge amount control means that is capable of individually controlling a liquid discharge amount of the second nozzle.

16. The method according to claim 15, wherein the panel comprises a color filter.

17. The method according to claim 15, wherein the panel comprises an electroluminescence device.

18. The method according to claim 15, wherein the panel comprises an electron-emitting device having a conductive thin film portion.

19. A panel manufacturing method which manufactures a panel used for a display device by discharging, onto a substrate, a liquid from a liquid discharge head having a plurality of nozzles for discharging the liquid, wherein a panel is manufactured by discharging, onto the substrate, the liquid from the liquid discharge head including a first nozzle that ejects the liquid and which has a first discharge driving element connected to a voltage control circuit capable of individually changing a voltage supplied to the first discharge driving element, and a second nozzle that ejects the liquid and which has a second discharge driving element which is never connected to a voltage control circuit that is capable of individually changing a voltage supplied to the second discharging driving element.

20. A color filter manufacturing method which manufactures a color filter by discharging, onto a substrate, a liquid from a liquid discharge head having a plurality of nozzles for discharging the liquid, wherein a color filter is manufactured by discharging, onto the substrate, a liquid from the liquid discharge head including a first nozzle that ejects the liquid and which has a discharge driving element connected to discharge amount control means capable of individually changing a liquid discharge amount of the first nozzle, and a second nozzle that ejects the liquid and which has a discharge driving element which is never connected to a discharge amount control means that is capable of individually controlling a liquid discharge amount of the second nozzle.

21. A method of manufacturing a liquid crystal display panel having a color filter, comprising the steps of:

manufacturing a color filter by the method according to claim 20; and inserting a liquid crystal compound into a space between the color filter and a counter substrate.

22. A method of manufacturing an apparatus having a liquid crystal display panel, comprising the steps of: manufacturing a liquid crystal display panel by the method according to claim 21; and connecting the liquid crystal display panel to a signal supply means which supplies the signal to the liquid crystal display panel.

* * * * *

UNITED STATES PATENT AND TRADEMARK OFFICE

CERTIFICATE OF CORRECTION

PATENT NO. : 7,188,919 B2
APPLICATION NO. : 10/607377
DATED : March 13, 2007
INVENTOR(S) : Satomura It is certified that error appears in the above-identified patent and that said Letters Patent is hereby corrected as shown below:

COLUMN 4:
Line 10, “number” should read --number of--.

COLUMN 6:
Line 50, “arrangement,” should read --arrangements,--.

COLUMN 11:
Line 52, “electrode” should read --electrodes--.

COLUMN 12:
Line 5, “Displayed” should read --Display--.

COLUMN 13:
Line 17, “of,” should read --of--.

COLUMN 17:
Line 45, “nozzle-1,” should read --nozzle -1,--.

COLUMN 18:
Line 7, “±10%,” should read --+10%,--.

COLUMN 24:
Line 34, “and-activation” should read --and activation--.

COLUMN 25:
Line 64, “at the” should read --the at--.

UNITED STATES PATENT AND TRADEMARK OFFICE

CERTIFICATE OF CORRECTION

PATENT NO. : 7,188,919 B2
APPLICATION NO. : 10/607377
DATED : March 13, 2007
INVENTOR(S) : Satomura It is certified that error appears in the above-identified patent and that said Letters Patent is hereby corrected as shown below:

COLUMN 30:
Line 18, "manu-" should begin a new paragraph.

Signed and Sealed this

Twenty-seventh Day of January, 2009

JOHN DOLL
*Acting Director of the United States Patent and Trademark Office*